US008228350B2

(12) United States Patent
Ng

(10) Patent No.: US 8,228,350 B2
(45) Date of Patent: Jul. 24, 2012

(54) DATA DEPENDENT DRIVE SCHEME AND DISPLAY

(75) Inventor: Sunny Yat-san Ng, Cupertino, CA (US)

(73) Assignee: OmniVision Technologies, Inc., Santa Clara, CA (US)

( * ) Notice: Subject to any disclaimer, the term of this patent is extended or adjusted under 35 U.S.C. 154(b) by 906 days.

(21) Appl. No.: 12/157,189

(22) Filed: Jun. 6, 2008

(65) Prior Publication Data

US 2009/0303207 A1 Dec. 10, 2009

(51) Int. Cl.
*G09G 5/10* (2006.01)

(52) U.S. Cl. ..... 345/690; 345/692; 345/214

(58) Field of Classification Search ..... 345/204, 345/690–693, 211, 214, 55, 76–77, 83–84, 345/89

See application file for complete search history.

(56) References Cited

U.S. PATENT DOCUMENTS

| | | | | |
|---|---|---|---|---|
| 4,591,842 | A | 5/1986 | Clarke, Jr. et al. | |
| 4,745,475 | A * | 5/1988 | Bicknell | 348/442 |
| 4,951,229 | A | 8/1990 | DiNicola et al. | |
| 5,285,214 | A | 2/1994 | Bowry | |
| 5,497,172 | A | 3/1996 | Doherty et al. | |
| 5,570,297 | A | 10/1996 | Brzezinski et al. | |
| 5,571,297 | A * | 11/1996 | Swei et al. | 51/298 |
| 5,598,188 | A * | 1/1997 | Gove et al. | 345/531 |
| 5,602,559 | A | 2/1997 | Kimura | |
| 5,619,228 | A | 4/1997 | Doherty | |
| 5,668,611 | A * | 9/1997 | Ernstoff et al. | 348/771 |
| 5,677,703 | A * | 10/1997 | Bhuva et al. | 345/84 |
| 5,680,156 | A * | 10/1997 | Gove et al. | 345/545 |
| 5,731,802 | A | 3/1998 | Aras et al. | |
| 5,748,164 | A * | 5/1998 | Handschy et al. | 345/89 |
| 5,757,347 | A | 5/1998 | Han | |
| 5,767,818 | A * | 6/1998 | Nishida | 345/1.1 |
| 5,940,142 | A | 8/1999 | Wakitani et al. | |
| 5,969,710 | A | 10/1999 | Doherty et al. | |
| 5,986,640 | A * | 11/1999 | Baldwin et al. | 345/596 |

(Continued)

FOREIGN PATENT DOCUMENTS

CN 1155136 A 7/1997

(Continued)

OTHER PUBLICATIONS

U.S. Appl. No. 12/157,166, Office Action dated Jul. 8, 2011.

(Continued)

*Primary Examiner* — Jason Mandeville
(74) *Attorney, Agent, or Firm* — Larry E. Henneman, Jr.; Henneman & Associates PLC

(57) ABSTRACT

A method for writing data to a display includes the steps of receiving a plurality of data bits, where each bit is associated with a different pixel of the display, reading the value of each data bit, determining whether each data bits has an off-state value, and generating a disable signal if each data bit has an off-state value. Responsive to a disable signal, the method further includes suspending the transfer of data to the pixels of the display, turning off a light source (e.g., an LED, laser, etc.) for a time period dependent on the significance of at least one of the data bits, and/or forcing each pixel of the display into an off state for a time period dependent on the significance of at least one of the data bits. A display driver circuit for performing the methods of the present invention is also disclosed.

45 Claims, 8 Drawing Sheets

U.S. PATENT DOCUMENTS 6,005,591 A 12/1999 Ogura et al.
6,008,785 A * 12/1999 Hewlett et al. ..... 345/85
6,072,452 A 6/2000 Worley, III et al.
6,100,939 A 8/2000 Kougami et al.
6,140,983 A 10/2000 Quanrud
6,144,356 A 11/2000 Weatherford et al.
6,144,364 A 11/2000 Otobe et al.
6,151,011 A 11/2000 Worley, III et al.
6,175,355 B1 * 1/2001 Reddy ..... 345/691
6,201,521 B1 3/2001 Doherty
6,215,466 B1 4/2001 Yamazaki et al.
6,232,963 B1 * 5/2001 Tew et al. ..... 345/204
6,246,386 B1 6/2001 Perner
6,295,054 B1 * 9/2001 McKnight ..... 345/205
6,326,980 B1 * 12/2001 Worley, III ..... 345/691
6,353,435 B2 3/2002 Kudo et al.
6,388,661 B1 5/2002 Richards
6,441,829 B1 8/2002 Blalock et al.
6,518,977 B1 2/2003 Naka et al.
6,636,206 B1 10/2003 Yatabe
6,639,602 B1 * 10/2003 Fukushima et al. ..... 345/531
6,771,240 B2 8/2004 Inoue et al.
6,809,717 B2 10/2004 Asao et al.
6,833,832 B2 12/2004 Wolverton
6,864,643 B2 3/2005 Min et al.
6,873,308 B2 3/2005 Sagano et al.
6,903,516 B2 6/2005 Tanada
6,965,357 B2 11/2005 Sakamoto et al.
6,972,773 B2 * 12/2005 Matsui et al. ..... 345/611
6,982,722 B1 1/2006 Alben et al.
6,985,164 B2 1/2006 Rogers et al.
7,071,905 B1 7/2006 Fan
7,172,297 B2 2/2007 Whitehead et al.
7,184,035 B2 2/2007 Sato et al.
7,196,683 B2 3/2007 Yamamoto et al.
7,274,363 B2 9/2007 Ishizuka et al.
7,301,518 B2 11/2007 Hosaka
7,317,464 B2 1/2008 Willis
7,471,273 B2 * 12/2008 Hewlett et al. ..... 345/87
7,499,065 B2 3/2009 Richards
7,545,396 B2 6/2009 Ng
7,580,047 B2 8/2009 Ng
7,580,048 B2 8/2009 Ng
7,580,049 B2 8/2009 Ng
7,605,831 B2 10/2009 Ng
7,692,671 B2 4/2010 Ng
7,903,123 B1 3/2011 Alben et al.
2001/0020951 A1 * 9/2001 Onagawa ..... 345/696
2002/0018054 A1 * 2/2002 Tojima et al. ..... 345/204
2002/0018073 A1 2/2002 Stradley et al.
2002/0085438 A1 7/2002 Wolverton
2002/0135553 A1 9/2002 Nagai et al.
2002/0145585 A1 10/2002 Richards
2003/0034948 A1 * 2/2003 Imamura ..... 345/98
2003/0048238 A1 3/2003 Tsuge et al.
2003/0063107 A1 4/2003 Thebault et al.
2003/0151599 A1 8/2003 Bone
2003/0210257 A1 11/2003 Hudson et al.
2004/0113879 A1 6/2004 Sekiguchi et al.
2004/0125117 A1 7/2004 Suzuki et al.
2004/0150596 A1 8/2004 Uchida et al.
2004/0150602 A1 8/2004 Furukawa et al.
2004/0218334 A1 * 11/2004 Martin et al. ..... 361/139
2004/0239593 A1 12/2004 Yamada
2004/0239606 A1 12/2004 Ota
2005/0062709 A1 3/2005 Zeiter et al.
2005/0062765 A1 3/2005 Hudson
2005/0110720 A1 5/2005 Akimoto et al.
2005/0110811 A1 5/2005 Lee et al.
2006/0001613 A1 1/2006 Routley et al.
2006/0017746 A1 1/2006 Weithbruch et al.
2006/0044325 A1 3/2006 Thebault et al.
2006/0066645 A1 3/2006 Ng
2006/0267896 A1 11/2006 Edwards
2007/0008252 A1 1/2007 Seki
2007/0091042 A1 4/2007 Chung et al.
2008/0259019 A1 10/2008 Ng
2009/0027360 A1 1/2009 Kwan et al.
2009/0027361 A1 1/2009 Kwan et al.
2009/0027362 A1 1/2009 Kwan et al.
2009/0027363 A1 1/2009 Kwan et al.
2009/0027364 A1 1/2009 Kwan et al.
2009/0303206 A1 * 12/2009 Ng ..... 345/204
2009/0303248 A1 12/2009 Ng
2010/0091004 A1 * 4/2010 Ng ..... 345/212
2010/0259553 A9 10/2010 Van Belle

FOREIGN PATENT DOCUMENTS

EP 0698874 A1 2/1996
EP 0720139 A2 7/1996
EP 0762375 A2 3/1997
EP 0774745 B1 5/1997
EP 1937035 A2 6/2008
JP 08-511635 A 12/1996
JP 09-034399 A 2/1997
JP 09-083911 A 3/1997
JP 09-212127 A 8/1997
JP 10-31455 A 2/1998
TW 544645 B 8/2003
TW 544650 B 8/2003
WO WO 94/09473 A1 4/1994
WO WO 95/27970 A1 10/1995
WO WO 97/40487 A1 10/1997

OTHER PUBLICATIONS

*An Overview of Flaws in Emerging Television Displays and Remedial Video Processing*, Gerard de Haan and Michiel A. Klompenhouwer, IEEE Transactions on Consumer Electronics, Aug. 2001, vol. 47, pp. 326-334.
U.S. Appl. No. 12/157,166, Office Action dated Dec. 23, 2011.
U.S. Appl. No. 12/157,166, Interview Summary dated Feb. 22, 2012.
U.S. Appl. No. 11/881,732, Office Action dated Aug. 22, 2011.
U.S. Appl. No. 11/881,732, Interview Summary dated Feb. 23, 2012.
U.S. Appl. No. 12/011,606, Office Action dated Feb. 17, 2012.
U.S. Appl. No. 12/011,606, Interview Summary dated Feb. 23, 2012.
U.S. Appl. No. 12/011,604, Office Action dated Feb. 14, 2012.
U.S. Appl. No. 12/011,604, Interview Summary dated Feb. 23, 2012.
U.S. Appl. No. 12/011,520, Office Action dated Oct. 7, 2011.
U.S. Appl. No. 12/011,520, Interview Summary dated Feb. 23, 2012.
U.S. Appl. No. 12/011,605, Office Action dated Oct. 7, 2011.
U.S. Appl. No. 12/011,605, Interview Summary dated Feb. 24, 2012.
U.S. Appl. No. 12/157,190, Office Action dated May 26, 2011.
U.S. Appl. No. 12/157,190, Office Action dated Mar. 7, 2012.
U.S. Appl. No. 11/154,984, Office Action dated Feb. 27, 2008.
U.S. Appl. No. 11/154,984, Office Action dated Oct. 15, 2008.
U.S. Appl. No. 11/154,984, Notice of Allowance dated Jan. 27, 2009.
PCT Application No. PCT/US2006/020096, International Search Report and Written Opinion dated Oct. 9, 2007.
PCT Application No. PCT/US2006/020096, International Preliminary Report on Patentability dated Jan. 3, 2008.
TW Application No. 095118593, Office Action dated Jul. 27, 2011 (English translation).
U.S. Appl. No. 11/171,496, Office Action dated Feb. 27, 2008.
U.S. Appl. No. 11/171,496, Office Action dated Dec. 19, 2008.
U.S. Appl. No. 11/171,496, Notice of Allowance dated Apr. 3, 2009.
U.S. Appl. No. 11/172,622, Office Action dated Sep. 24, 2008.
U.S. Appl. No. 11/172,622, Notice of Allowance dated Jun. 8, 2009.
U.S. Appl. No. 11/172,621, Office Action dated Sep. 15, 2008.
U.S. Appl. No. 11/172,621, Notice of Allowance dated Apr. 17, 2009.
U.S. Appl. No. 11/172,382, Office Action dated Sep. 2, 2008.
U.S. Appl. No. 11/172,382, Office Action dated Apr. 10, 2009.
U.S. Appl. No. 11/172,382, Notice of Allowance dated Nov. 18, 2009.
U.S. Appl. No. 11/172,623, Office Action dated Sep. 23, 2008.
U.S. Appl. No. 11/172,623, Notice of Allowance dated Apr. 16, 2009.
U.S. Appl. No. 12/077,536, Office Action dated Jan. 5, 2012.
U.S. Appl. No. 10/949,703, Office Action dated Aug. 14, 2009.
U.S. Appl. No. 10/949,703, Notice of Abandonment dated Mar. 1, 2010.
U.S. Appl. No. 09/032,174, Office Action dated Dec. 20, 1999.
U.S. Appl. No. 09/032,174, Notice of Allowance dated Jun. 2, 2000.

PCT Application No. PCT/US1999/003847, International Search Report dated Jun. 16, 1999.
PCT Application No. PCT/US1999/003847, Written Opinion dated Mar. 1, 2000.
PCT Application No. PCT/US1999/003847, International Preliminary Examination Report dated Jul. 11, 2000.
CA Application No. 2,322,510, Office Action dated Oct. 13, 2006.
CA Application No. 2,322,510, Office Action dated Sep. 4, 2007.
CA Application No. 2,322,510, Notice of Allowance dated Sep. 11, 2008.
CN Application No. 99805193.4, Office Action dated Jan. 16, 2004 (English translation).
CN Application No. 99805193.4, Office Action dated Aug. 6, 2004 (English translation).
CN Application No. 99805193.4, Notice of Allowance dated Apr. 29, 2005 (English translation).
EP Application No. 99 936 139.7, Office Action dated Jul. 24, 2007.
EP Application No. 99 936 139.7, Office Action dated Sep. 28, 2009.
EP Application No. 99 936 139.7, Notice of Abandonment dated May 17, 2010.
JP Application No. 2000-533866, Office Action dated Sep. 15, 2009 (English translation).
JP Application No. 2000-533866, Office Action dated Apr. 7, 2010 (English translation).
JP Application No. 2000-533866, Office Action dated Nov. 1, 2010 (English translation).
U.S. Appl. No. 11/881,732, Notice of Allowance dated May 3, 2012.
U.S. Appl. No. 12/011,606, Notice of Allowance dated May 4, 2012.
U.S. Appl. No. 12/011,604, Interview Summary dated May 4, 2012.
U.S. Appl. No. 12/011,604, Notice of Allowance dated May 4, 2012.
U.S. Appl. No. 12/011,520, Notice of Allowance dated May 3, 2012.
U.S. Appl. No. 12/011,605, Notice of Allowance dated May 4, 2012.
U.S. Appl. No. 12/157,166, Notice of Allowance dated May 11, 2012.

* cited by examiner

DATA DEPENDENT DRIVE SCHEME AND DISPLAY

BACKGROUND

1. Field of the Invention

This invention relates generally to display driving schemes and displays and more particularly to a system and method for disabling particular display and display driver operations during display modulation based on the display data.

2. Description of the Background Art

Decreasing power consumption and heat generation in display systems have always been important design criteria for display engineers. This has especially been the case in recent years because displays (e.g., televisions, computer monitors, micro-LCDs, etc.) have been increasing in size and/or resolution. For example, displays having a resolution of at least 1920×1080 pixels are now common, as are displays that are larger than fifty inches diagonally.

As will be described below, lowering power consumption and heat generation are sympathetic goals. Often, lowering power consumption in a display system will also lower the amount of heat generated by the display system. Conversely, an increase in power consumed in a display system will increase the amount of heat generated by that display system. In addition, often when excess heat is generated, still more power is consumed to cool the system by powering cooling components.

Display engineers try to reduce the power consumed by a display and its associated driving components for various reasons. As described above, one of the most important reasons is that power consumption is directly tied to the amount of waste heat that a display system generates. Furthermore, conserving power increases battery life in portable electronic devices, especially those with high-resolution displays that require high bandwidths to supply image data and control signals to the display. Third, as the power requirements of a display system increase, the components (e.g., heavier-duty busses, extra cooling equipment, etc.) of that display system will also increase to handle the additional electrical load on the display system.

There are also many reasons why display engineers try to reduce the amount of heat generated by a display system. First, as described above, when a display system produces more heat, more cooling components (e.g., cooling fans, heat sinks, vents, etc.) have to be incorporated into the display system to compensate for the heat and cool the system to operating temperature. Additionally, excessive heat can damage many of the display system components over time and degrade display performance and/or cause catastrophic device failure. For example, the image quality of liquid crystal displays is susceptible to excessive heat build up. Also, integrated-circuit micro-processors have very specific temperature operating ranges that have to be maintained. As those integrated circuits handle higher data bandwidths more heat builds up more rapidly.

Finally, many display systems have light sources (e.g., lamps, etc.) used to illuminate the display. Such light sources often generate large amounts of heat near display components also degrading their performance over time and/or causing catastrophic failure. Therefore, display systems would also benefit if the heat generated by the lamp could be reduced or discharged away from the display components.

What is needed, therefore, is a system and method that conserves power during display system operation. What is also needed is a system and method that reduces heat produced by the display system during operation.

SUMMARY

The present invention overcomes the problems associated with the prior art by providing a novel display driver and method in order to reduce power consumption and heat build-up within the display driver and associated display system. In particular, the invention facilitates disabling particular display system and display driver operations depending on the display data.

A method for writing data to a display includes the steps of receiving a plurality of data bits each associated with a different pixel of the display, reading the value of the each of the data bits, determining whether each of the data bits has an off-state value, and generating a disable signal if each of the data bits has an off-state value. The step of receiving data bits can include receiving a plurality of multi-bit data words and planarizing the data words according to bit plane (i.e., by significance), in which case, the step of reading the data bits includes reading the data bits according to bit plane. Disable signals can be generated for each bit plane. In addition, disable signals can be stored as separate indicators, each set to a predetermined value.

If at least one of the data bits is determined to have an on-state value, then the method includes the step of transferring the data bits (i.e., the particular bit plane) to the pixels of the display. Alternatively, if a disable signal is generated, then the method further includes suspending the transfer of data bits to the pixels of the display. For example, the method can include suspending the read data bits (e.g., a first bit plane) from being transferred to the display. In addition, the method can include suspending a second plurality of data bits (e.g., a second bit plane) from being transferred to the pixels of the display.

A particular method includes suspending a second plurality of sequential bits from being transferred to the display, responsive to one or more disable signals, where the first plurality of bits received are sequential bits. Sequential bits have special properties in that they indicate the value of at least one other sequential bit associated with a particular pixel. For example, where the plurality of bits and the second plurality of bits are sequential bits and the plurality of bits each has an off-state value, then the plurality of sequential bits would indicate that each of the second plurality of sequential bits also was in an off-state.

In an optional step, the method includes forcing all of the pixels of the display into an off-state responsive to the disable signal. In another optional step, the method includes a step of turning off a light source (e.g., an LED, laser, etc.) for a time period based on the significance of one or more of the received data bits in response to the disable signal. In yet another optional step, the method includes receiving a binary-weighted data word and converting at least one of the binary-weighted bits in the binary weighted data word into a sequential bit and/or an arbitrarily-weighted bit.

A display driver circuit is also disclosed for driving a display having an array of pixels arranged in a plurality of columns and a plurality of rows. In a particular embodiment, the display driver circuit includes an input terminal set for receiving a plurality of data bits associated with different pixels of the display and detection logic that is operative to read the value of each of the data bits, determine whether each of the data bits has a value indicative of an off-state, and generate a disable signal if each of the data bits has a value indicative of an off-state. Furthermore, the display driver circuit can include an output controller operative to suspend the transfer of data to the pixels of the display responsive to the disable signals. The display driver circuit can also include a data planarizer operative to receive a plurality of multi-bit data words via the input terminal set and planarize the bits of the multi-bit data words according to bit plane (i.e., significance) such that the detection logic reads the value of data bits according to bit plane. Note that the output controller can generate a plurality of disable signals for one or more bit planes in a frame, and that the disable signals can be stored as indicators.

In a particular embodiment, the output controller is operative to suspend the transfer of one or more bit planes of data to the display when the data bits are sequential bits, because a bit plane of sequential bits indicates the values of the bits in at least one other bit plane of sequential bits.

Optionally, the output controller can force all the pixels of the display into an off-state responsive to the disable signal. In another particular embodiment, the display driver circuit can include a light source controller operative to turn off a light source (e.g., an LED, laser, etc.) in response to the disable signal. In yet another embodiment, the display driver circuit includes a data manager operative to receive a binary-weighted data word and convert at least one of the binary-weighted bits in the binary weighted data word into a sequential bit and/or an arbitrarily-weighted bit.

A method for controlling a light source (e.g., an LED, laser, etc.) in a display system is also disclosed. That method includes the steps of receiving a plurality of data bits, each associated with a different pixel of a display, reading the value of each of the data bits, determining whether each of the data bits has a value indicative of an off-state, and generating a disable signal if each of the data bits has a value indicative of the off-state. The method further includes, responsive to the disable signals, turning off the light source for a time period dependent on the significance of at least one of the data bits. The method can also include turning the light source back on in the absence of a disable signal.

A particular method includes receiving a plurality of multi-bit data words, each associated with a different pixel of the display, and planarizing the bits of the multi-bit data words according to bit plane (i.e., by significance), and turning off the light source, responsive to a disable signal, for a time period greater than or equal to the significance of the bits in a particular bit plane. For example, if each bit in a first bit plane have a value indicative of an off-state, then the method includes turning off the light source for a time period at least equal to the significance of each bit in the first bit plane. Furthermore, if the bits in the first bit plane are sequential bits that indicate the values of the bits in a second bit plane, then the method includes disabling the light source for a time period equal to the significance of the bits in the first bit plane plus the significance of the bits in the second bit plane. Where the data is planarized, the method can include generating a separate disable signal for each bit plane.

In an optional step, the method further includes forcing all of the pixels of the display into an off-state responsive to the disable signal. In another optional step, the method further includes receiving a binary-weighted data word and converting at least one of the binary-weighted bits in the binary-weighted data word into a sequential bit and/or an arbitrarily-weighted bit.

A display driver circuit for controlling a light source is also disclosed. The display driver circuit includes an input terminal set operative to receive a plurality of data bits each associated with a different pixel of a display and detection logic operative to read the value of each of the data bits, determine whether each of the data bits has a value indicative of an off-state, and generate a disable signal causing the light source to turn off if each of the data bits has a value indicative of the off-state. The display driver also includes a light source controller, responsive to the disable signal, and operative to turn off the light source for a period of time dependent on at least one of the data bits. The light source controller is further operative to turn the light source on in the absence of a disable signal.

In a particular embodiment, the display driver circuit includes a planarizer operative to receive a plurality of multi-bit data words, each associated with a different pixel of the display, and planarize the bits of the data words according to bit plane. Then, the light source controller, responsive to a disable signal is operative to turn off the light source for a time period greater than or equal to the significance of one or more of the bit planes. For example, where the bit plane contains sequential bits, the light source controller can turn off the light source for a time period equal to the significance of one or more bit planes. Again, where the data is planarized, the detection logic can generate a separate disable signal for each bit plane.

Optionally, the output controller can force all the pixels of the display into an off-state responsive to the disable signal. In another embodiment, the display driver circuit includes a data manager operative to receive a binary-weighted data word and convert at least one of the binary-weighted bits in the binary weighted data word into a sequential bit and/or an arbitrarily-weighted bit.

The invention is also directed to non-transitory, electronically-readable storage media that store code for causing an electronic device to perform methods of the invention. The term "non-transitory" is intended to distinguish storage media from transitory electrical signals. However, storage devices whose contents can be changed are considered to be "non-transitory".

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art by providing a system and method that reduces power consumption and heat build-up within a display system. In the following description, numerous specific details are set forth (e.g., particular display driver components, particular data and voltage busses, etc.) in order to provide a thorough understanding of the invention. Those skilled in the art will recognize, however, that the invention may be practiced apart from these specific details. In other instances, details of well-known display driving practices (e.g. routine optimization, component synchronization specifics, etc.) and components have been omitted, so as not to unnecessarily obscure the present invention.

Figure 1:
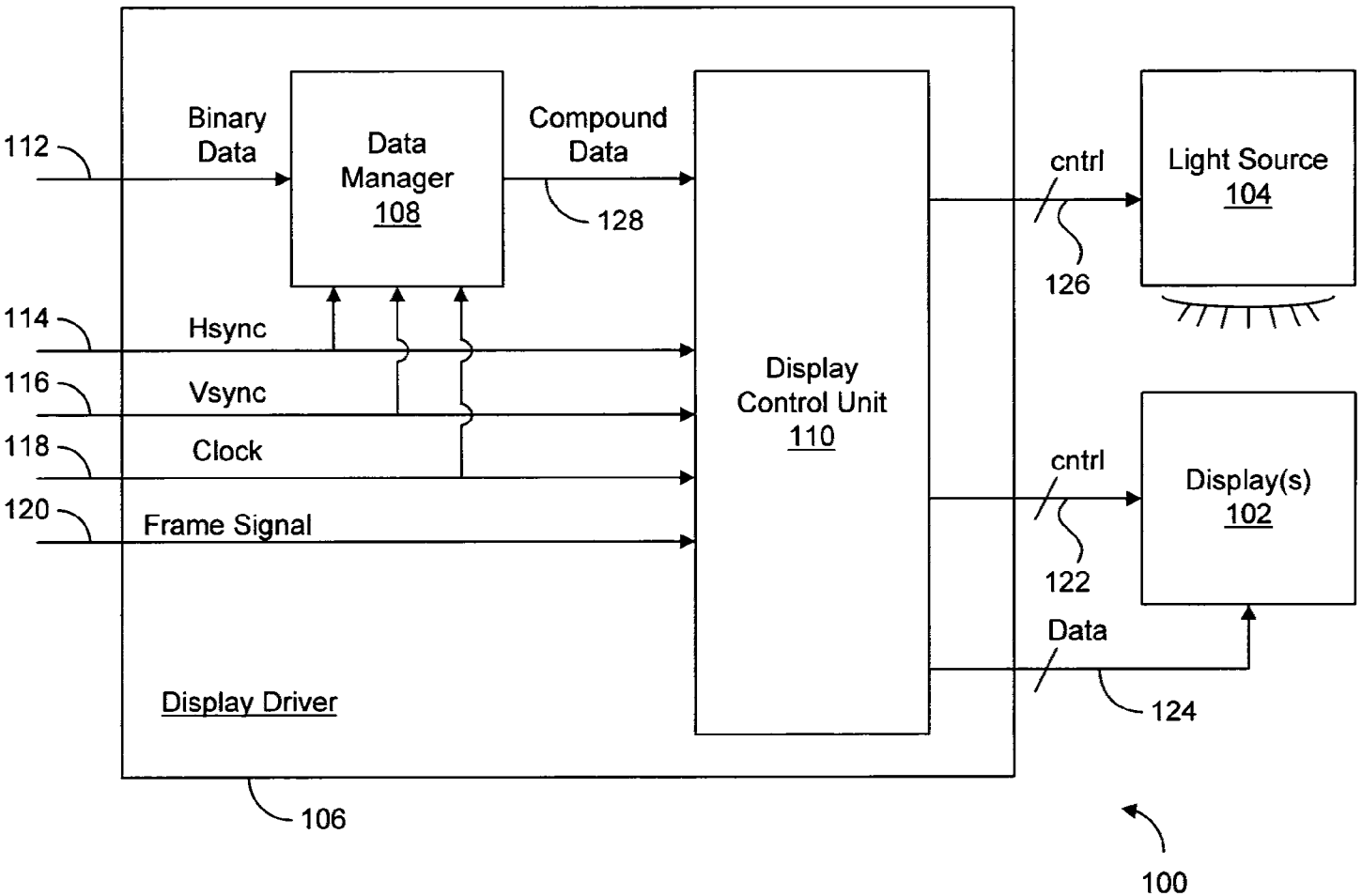
FIG. 1 is a block diagram of a display system according to one embodiment of the present invention.

FIG. 1 shows a block diagram of a display system 100 according to one embodiment of the present invention. Display system 100 includes one or more display(s) 102 (one in the current embodiment) for displaying image data, a light source 104 that illuminates display 102 and the image produced thereby, and a display driver 106. Display driver 106 includes a data manager 108 and a display control unit 110. Display driver 106 has a plurality of inputs including a data input terminal set 112, an Hsync input 114, a Vsync input 116, a clock input 118, and a frame signal input 120. Display driver 106 also has a plurality of outputs including a display control bus 122, a display data bus 124, and a light source control bus 126. Display 102 receives control signals from display driver 106 via display control bus 122 and display data via data bus 124. Similarly, light source 104 receives control signals from display driver 106 via light source control bus 126.

Display 102 is any display having an array of pixels (not shown) arranged in a plurality of columns and a plurality of rows (e.g., a reflective or transmissive liquid crystal display, a deformable mirror device, etc.). In the present embodiment, display 104 is a liquid crystal display having an array of pixels arranged in 1920 columns and 1080 rows. Display 102 receives display data (e.g., bits of compound data words) on display data bus 124, and depending on the signals asserted by display driver 102 on display control bus 122, asserts the display data on its pixels to produce an image. The pixels of display 102 are driven via pulse-width-modulation (PWM). In PWM, different intensity values are represented by multi-bit words (i.e., binary numbers). The multi-bit words are converted to a series of pulses, whose time-averaged root-mean-square (RMS) voltage corresponds to the analog voltage necessary to attain the desired intensity value for a particular pixel. For example, in an 8-bit PWM scheme, the frame time (time in which an intensity value is written to every pixel) is divided into 255 time intervals, where each bit in the multi-bit word represents a certain number of those time intervals. Finally, in the present embodiment, a pixel in an "on-state" is illuminated producing a portion of an image, while a pixel in an "off-state" is dark.

In the present invention, display driver 106 drives a single display 102 in color field-sequential mode, where a single display 102 modulates each color of light rather than a separate display for each color. However, the present invention can be used with other display driving systems, such as those involving color-separation and recombination.

Light source 104 illuminates display 102 such that an image produced by the pixels of display 102 can be seen by a viewer of display 102. In the present embodiment, light source 104 is either a light-emitting-diode (LED)-based light source or a laser-based light source. LED- and laser-based light sources are advantageous to the present invention because they are able to turn on and off very quickly multiple times during an image frame. Alternatively, light source 104 can be a mercury ultra-high pressure (UHP) lamp, or some other type of light source, that may or may not be able to turn on and off rapidly, because some advantages of the invention may be achieved without turning the lamp off, as is described elsewhere herein.

Display driver 106 operates as follows. Data manager 108 receives binary-weighted data words via data via data input terminal set 112, converts the binary-weighted data words into compound data words, and transfers those compound data words to display control unit 110 via compound data bus 128. Data manager 108 also utilizes the Hsync, Vsync, and clock signals asserted on inputs 114, 116, and 118, respectively, to convert the binary-weighted data into compound data and transfer the compound data words to display control unit 110. Each compound data word is associated with a different one of the pixels of display 102. The compound data words created by data manager 108 will be discussed in more detail below with respect to FIG. 2.

Display control unit 110 receives the compound data words from data manager 108 via compound data bus 128, and depending on the values of the bits in the compound data words, is operative to suspend the transfer of display data to display 102, force all the pixels of display 102 into an off-state, and/or turn-off light source 104 for a particular time period dependent on the compound data processed by display control unit 110. Furthermore, if the compound data received by display control unit 110 contained sequential bits (which will be described in further detail below), then display control unit 110 can also be operative to suspend data transfer, force the pixels of display 102 into an off state, and/or turn off light source 104 for extended periods of time (e.g., for multiple bit planes) during a frame. Display control unit 110 also utilizes Hsync, Vsync, and clock signals via inputs 114, 116, and 118, respectively, to carry out its operations. In addition, display control unit 110 receives a frame signal on frame signal input 120 that indicates to display control unit 110 when a frame begins and when a frame ends.

In a particular embodiment, display control unit 110 receives compound data via bus 128, reads the data, determines whether particular compound data bits have a value indicative of an off-state, and suspends transfer of at least some of the compound data to display 102 if all or a portion of the read data has a value indicative of an off-state. Optionally, display control unit 110 can also force all the pixels of display 102 into an off-state while data transfer to display 102 is suspended by asserting display control signals on display control bus 122. In addition, if all or a portion of the read data had a value indicative of an off-state, then display control unit 110 could also turn off light source 104 for a time period dependent on the significance of one or more bits of the compound data by asserting control signals on light source control bus 126.

Conversely, if some of the compound data had an on-state value, then display control unit would transfer the compound data to the pixels of display 102 via display data bus 124 and by asserting the appropriate control signals (e.g., write signals, row addresses, select signals, etc.) on display control bus 122. In addition, if some of the compound data had an on-state value, display control unit 110 would keep light source 104 illuminated.

As described above, display driver 106 writes compound data to the pixels of display 102 where the data includes bits that have an on-state value, while suspending data transfer to display 102 where all the data bits have an off-state value. In addition, display driver 106 facilitates turning off light source 106 and forcing the pixels of display 102 into an off-state where all data bits have a value indicative of an off-state.

The present invention provides many advantages over the prior art. First, because display driver 106 can suspend data transfer to display 102 and turn off light source 104 during portions of a frame time, display driver 106 conserves power that would otherwise be drawn by display control unit 110, display 102, and light source 104. Furthermore, because display 102, light source 104, and display driver 106 are using less power, less heat will be generated by display system 100, which will result in an overall cooler display system 100 and will extend the longevity of display system 100. Third, the present invention reduces the average bandwidth requirements between display driver 106 and display 102 by reducing the amount of data that needs to be transferred to display 102.

Figure 2:
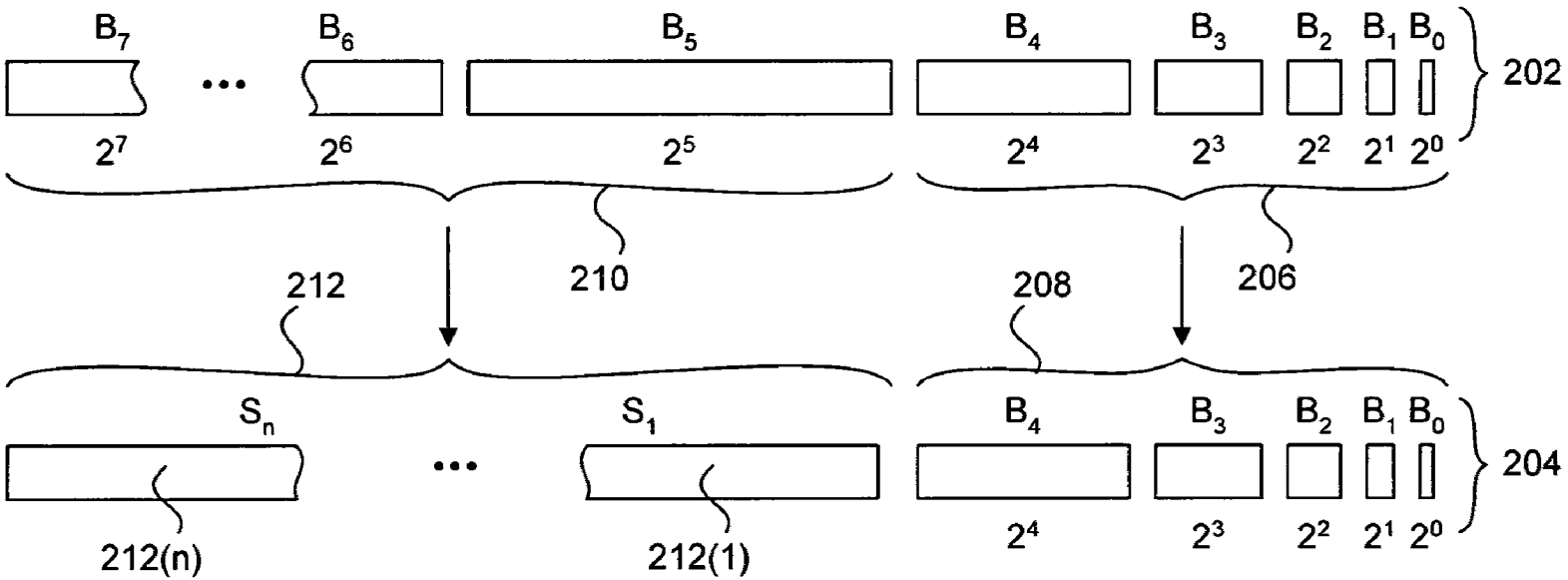
FIG. 2 is a diagram showing the conversion of a binary-weighted data word into one example of a compound data word according to the present invention.

FIG. 2 is a diagram showing how data manager 108 converts a binary-weighted data word 202 into a compound data word 204 according to the present invention. In the present example, binary-weighted data word 202 includes a plurality of binary-weighted bits, B0-B7. Binary-weighted data word 202 defines $(2^n-1)$ intensity values, where n equal the number of bits in data word 202. In this case, because n=8 (B0-B8), binary-weighted data word 202 can define up to 256 intensity values, including zero.

According to the present invention, data manager 108 takes a first group of bits 206 from binary-weighted data word 202 and creates a first group of binary-weighted bits 208 in compound data word 204. In this case, first group of bits 206 and 208 are the same bits. Data manager 108 then transforms a second group of bits 210 of binary-weighted data word 202 into one or more sequential bits 212(1-*m*) in compound data word 204.

In the present embodiment, data manager 108 converts second group of bits 210 into a plurality of sequential bits 212 that have the same weighted value as the second group of bits 210 in binary-weighted data word 202. For example, data manager 108 could convert binary bits 210 (which have a combined weighted-value of 224) into four sequential bits 212 (i.e., m=4), each having a weighted value of 56. Alternatively, data manager 108 could convert binary bits 210 into eight sequential bits 212 (i.e., m=8), each having a weighted value of 28. In still yet another alternative embodiment, data manager 108 could create (m) arbitrarily-weighted sequential bits that have a combined weighed-value of 224. As still another example, data manager could create (m) sequential bits that have a combined weight that is more or less than the combined weight of binary-bits 210 in binary-weighted data word 202. As yet another example, data manager 108 could convert any or all of the binary bits in binary-weighted data word into compound data word 204.

As will be described below, sequential bits 212 have a special property in that each sequential bit in compound data word 204 indicates the value of at least one other sequential bit in compound data word 204. In particular, all sequential bits 212 in compound data word 204 following the first sequential bit having an off-state value will also have an off-state value. Similarly, all sequential bits 212 prior to the first sequential bit in compound data word 204 having an off-value will have an on-state value.

Figure 3:
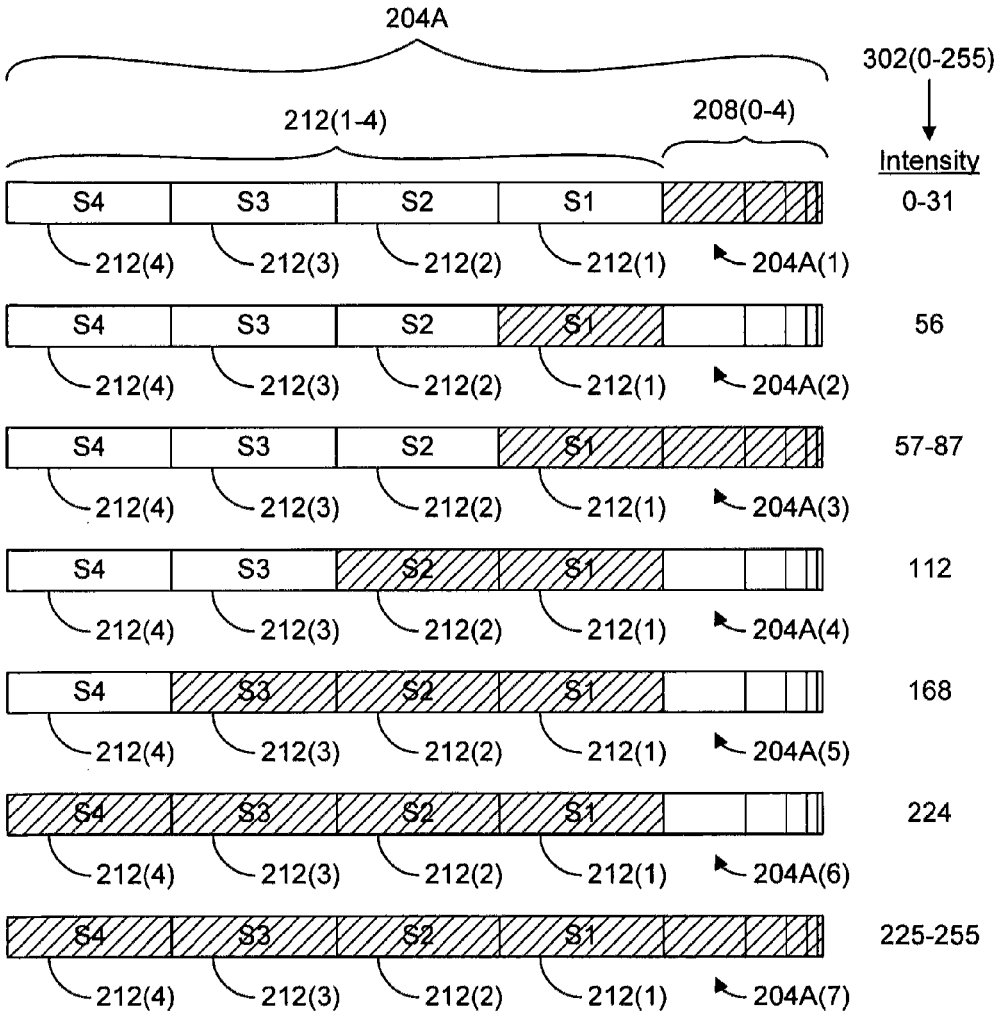
FIG. 3 is a diagram showing an exemplary compound data word that contains sequential bits defining various intensity values according to the present invention.

FIG. 3 is a diagram that shows an exemplary compound data word 204A defining various intensity values or intensity ranges 302. Note that FIG. 3 contains seven different compound data words 204A, labeled 204A(1) through 204A(7), each representing a different intensity value or range 302. In the present example, compound data word 204A includes a group of five binary-weighted data bits 208(0-4) (i.e., B0-B4) and a group of four sequential bits 212(1-4) (labeled S1-S4). Note that sequential bits 212(1-4) are equally-weighted, each having a weighted-value of 56. Data words 204A(1-7) define particular intensity values 302 by setting different bits of compound data word 204A to either an on-state (indicated by a hashed bit) or an off-state (indicated by a blank bit).

Compound data word 204A(1) can define any of intensity values 302(0-31) depending on the values assigned to bits B0-B4. For example, if B0 and B3 were set to an on-state, then compound data word 204A(1) would have an intensity value of nine (i.e., 302(9)). In contrast, compound data word 204A(2) has a first sequential bit 212(1) set to an on-state such that compound data word 204A(2) defines intensity value 302(56). In compound data word 204A(3), first sequential bit 212(1) and any of binary bits 208 are set to an on-state such that compound data word 204A(3) defines any of intensity values 302(57-97). In data word 204A(4), first sequential bit 212(1) and second sequential bit 212(2) are set to an on-state such that compound data word 204A(4) defines the intensity value 302(112). In data word 204A(5), first sequential bit 212(1), second sequential bit 212(2), and third sequential bit 212(3) are each set to an on-state such that compound data word 204A defines the intensity value 302(168). In data word 204A(6), first sequential bit 212(1), second sequential bit 212(2), third sequential bit 212(3), and fourth sequential bit 212(4) are set to an on-state such that compound data word 204A defines the intensity value 302(224). Finally, in data word 204A(7), each of sequential bits 212(1-4) and any of binary bits 208 are set to an on-state, thereby defining any of intensity values 302(225-255).

As described above, sequential bits 212 have special properties, which are illustrated by the various intensity values defined by data words 204A(1-7). Recall from FIG. 2, that all sequential bits 212 in compound data word 204 following the first sequential bit having an off-state value will also have an off-state value. Similarly, all sequential bits 212 prior to the first sequential bit in compound data word 204 having an off-value will have an on-state value.

For example, in data word 204A(2), sequential bit 212(2) is the first sequential bit 212 having an off state. Accordingly, the subsequent sequential bits 212(3-4) in data word 204A2 also have an off-state value and the preceding sequential bit 212(1) has an on-state value. The same properties exist for sequential bit 212(3) in data word 204A(4). In data word 204A(5), sequential bit 212(4) is the first sequential bit having an off-value. Although there are no subsequent sequential bits, the immediately preceding sequential bit 212(3) has an on-state value. Similarly, in data word 204A(1), the first sequential bit 212(1) has an off-state value, and therefore, the subsequent sequential bits in data word 204A(1) also have an off-state value. As the above examples show, sequential bits 212 have the special property that each sequential bit 212 indicates the value of at least one other bit in compound data word 204A.

Figure 4:
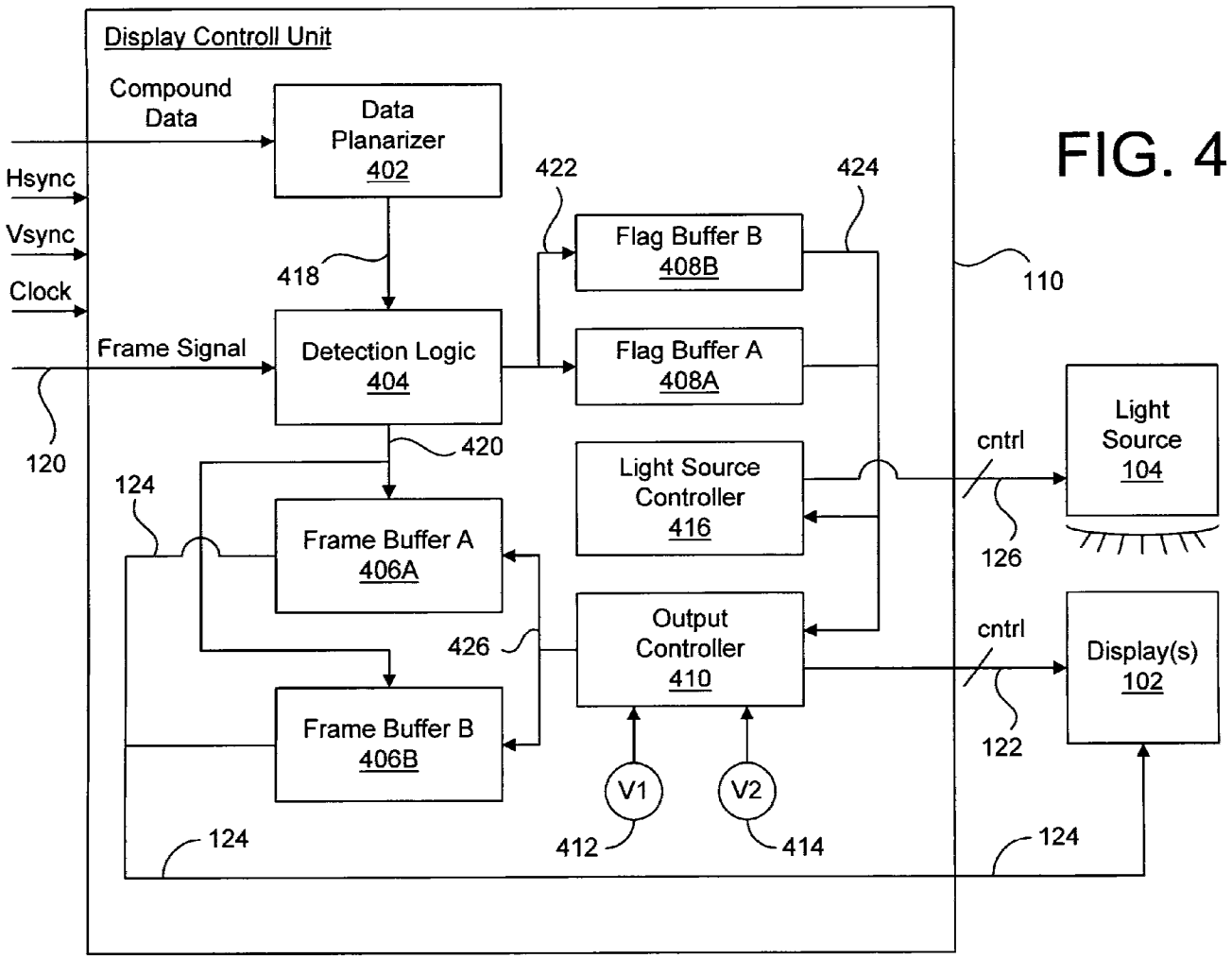
FIG. 4 is a block diagram of the display control unit shown in FIG. 1 according to one embodiment of the present invention.

FIG. 4 is a block diagram of display control unit 110 of FIG. 1 according to a particular embodiment of the present invention. Display control unit 110 includes a data planarizer 402, detection logic 404, a first frame buffer 406A, a second frame buffer 406B, a first flag buffer 408A, a second frame buffer 408B, an output controller 410, a first voltage supply terminal 412, a second voltage supply terminal 414, and a light source controller 416. In addition, display control unit 110 receives the inputs and generates the outputs shown in FIG. 1. Note that Hsync input 114, Vsync input 116, and clock input 118 are shown as inputs generally (i.e., not coupled to any particular element of display control unit 110) so as not to obscure the present invention. Those skilled in the art will recognize that inputs 114, 116, and 118 can be used to synchronize the components of display driver 102, including display control unit 110.

Display control unit 110 operates as follows. Data planarizer 402 receives compound data words 204 via compound data input bus 128 from data manager 108, planarizes the compound data words 204 according to bit plane (i.e., according to bit significance), and outputs the planarized data by bit plane to detection logic 404 via data lines 418. In particular, data planarizer 402 can receive nine-bit compound data words 204A and outputs a plurality of bits by bit plane on data lines 418. The bits that are output in a particular bit plane each have the same significance. Therefore, in the case of compound data word 204A, for each frame of data to be asserted on display 102, data planarizer 402 would first output a plurality of B0 bits, then a plurality of B1 bits, then a plurality of B2 bits and so on until data planarizer outputs a plurality of sequential bits 212(4). In general, data planarizer 402 planarizes one frame of image data at a time, where a frame of image data is the time required to assert all bits of a compound data word on each pixel of display 102. One example of a particular data planarizer is described in U.S. Pat. No. 6,144,356 issued on Nov. 7, 2000, and entitled "System and Method for Data Planarization," which is incorporated by reference herein in its entirety.

Detection logic 404 reads the data bits asserted on data lines 418 and generates disable signals depending on the values of the data bits that it receives. In particular, detection logic 404 receives a plurality of data bits, reads the data bits, determines whether each of the bits that it has read has a value indicative of an off-state, and if each of the bits has an off-state value, then detection logic generates a disable signal. The disable signal generated by detection logic 404 suspends transfer of the data bits to display 102, turns off light source 104 for a time period dependent on the significance of one or more data bits, and/or forces the pixels of display to an off-state, as will be described below. In the present embodiment, detection logic 404 receives data bits according to bit plane, reads all the bits in a particular bit plane, determines whether all the bits in a particular bit plane have a value indicative of an off-state, and generates a disable signal if all the bits in the bit plane have an off state.

Once detection logic 404 performs the steps described above, detection logic 404 transfers the read data bits to one of frame buffers 406A and 406B via data lines 420. In the present embodiment, detection logic 404 transfers the data bits to one of frame buffers 406A or 406B according to bit plane. Detection logic 404 continues to transfer data bits by bit plane to one of frame buffers 406A and 406B until a complete frame of image data (i.e., 9 bit planes for data words 204A) is transferred to the corresponding frame buffer 406A or 406B.

Frame buffers 406A and 406B are "ping-pong" frame buffers such that detection logic 404 can load one of one of frame buffers 406A and 406B with data while data is being read out of the other of frame buffers 406A and 406B and transferred to the pixels of display 102. Each of frame buffers 406A and 406B have enough memory capacity to store one complete frame of image data. As will be described below, frame buffers 406A and 406B assert data on display data bus 124 according to bit plane under the control of output controller 410.

Detection logic 404 also sets an indicator to a predetermined value if it generates a disable signal for a particular bit plane of data. In particular, flag buffer 408A and 408B each contain an indicator flag associated with each bit plane in compound data word 204. Accordingly, as detection logic 404 reads each bit plane of data and determines whether all the data bits in a bit plane have an off-state value, detection logic 404 will set an indicator flag (e.g., to a value of 1) in one of flag buffers 408A and 408B via indicator line 422 if all the bits in a particular bit plane have an off-state value. In this sense, detection logic 404 generates a separate disable signal for each bit plane in a frame of data, and records that disable signal by setting an indicator flag in an associated one of flag buffers 408A and 408B. In the case of compound data word 204A, which has nine bit planes, each of flag buffers 408A and 408B would contain nine single-bit indicator flags, one for each bit plane in a frame of data. As will be described in more detail below, flag buffers 408A and 408B are further operative to selectively provide the value of the indicator flags to one or both of output controller 410 and light source controller 416.

Note also that detection logic 404 sets indicator flag in either flag buffer 408A or 408B depending on which frame buffer 406A or 406B that detection logic is writing data to at the time. If detection logic 404 is writing data into frame buffer 406A, then detection logic 404 is setting indicator flags in flag buffer 408A. Similarly, if detection logic 404 is writing data into frame buffer 406B, then detection logic 404 is also setting indicator flags in flag buffer 408B.

Detection logic 404 is able to determine the beginning and end of each frame based on the frame signal (e.g., the Vsynch signal) provided on frame signal line 120. Upon receipt of the frame signal, detection logic 404 is operative to set indicator flags in one of flag buffers 408A and 408B, based on the planarized display data from planarizer 402. When frame signal line 120 indicates the beginning of the next frame, detection logic 404 is operative to set the indicator flags in the other one of flag buffers 408A and 408B, based on the planarized display data from planarizer 402. In this manner, frame signal line 120 provides control signals that cause detection logic 404 to set the indicators in flag buffers 408A and 408B in alternating fashion. In this particular embodiment, the Vsynch signal is used as frame signal 120.

Output controller 410, depending on the disable signals generated by detection logic 404, is operative to transfer display data from frame buffers 406A and 406B to the pixels of display 102 or suspend the transfer of display data from frame buffers 406A and 406B to the pixels of display 102. In addition, output controller 410 can be further operative to force the pixels of display 102 into an off-state responsive to a disable signal generated by detection logic 404.

In the present embodiment, output controller 410 writes display data to the pixels of display 102 according to bit plane from one of frame buffers 406A and 406B. At the beginning of a frame, output controller 410 reads the indicator flags from one of flag buffers 408A and 408B that were set by detection logic 404 during the previous frame. Output controller 410 then attempts to load display data according to bit plane. For each bit plane of display data (e.g., bit planes B0-S4 in the case of data word 204A), output controller 410 checks the associated indicator flag set in one of flag buffers 408A and 408B via an indicator read bus 424. If the indicator flag is set to a value of zero, indicating that at least one bit in that bit plane has a value indicative of an on-state, then output controller 410 instructs the associated frame buffer 406A or 406B via a frame buffer control bus 426 to transfer display data in that bit plane to the pixels of display 102 via display data bus 124. At the same time, output controller 410 asserts signals (e.g., write signals, row addresses, etc.) on display control bus 122 that cause the planarized display data asserted on data bus 124 to be written to the pixels of display 102 an asserted for an amount of time equal to their significance. Output controller 410 then processes the remaining bit planes in the same way until the frame is over.

In contrast, if an indicator flag is set to a value of one, indicating that all the bits in a particular bit plane have a value indicative of an off-state, then output controller 410 proceeds according to either of two following methods.

In the first method, output controller 410 suspends the transfer of display data in a bit plane from one of frame buffers 406A or 406B to the pixels of display 102 if the indicator flag associated with that bit plane is set to a predetermined value (e.g., a value of one). Furthermore, if the suspended bit plane is a sequential bit plane (i.e., one containing sequential bits 212), then output controller 410 could suspend all further data transfers from the frame buffer 406A or 406B within a frame. Because of the special properties of the sequential bits 212, output controller 410 would suspend transfer of display data associated with all subsequent sequential bit planes. In particular, because all the sequential bits in one bit plane have an off-state value, all the sequential bits in subsequent bit planes in that frame must also have an off-state value. Accordingly, if output controller 410 suspends transfer of one sequential bit plane between frame buffer 406A or 406B and the pixels of display 102, then output controller 410 can suspend all subsequent bit planes containing sequential bits within that frame. Note that by utilizing sequential bits 212, output controller 410 can suspend the transfer of many bit planes within a frame based upon a single disable signal (e.g., the first sequential bit plane indicator set to a value of one).

According to this first method, output controller 410 can also optionally force the pixels of display 102 into an off-state when data transfer is suspended between one of frame buffers 406A or 406B and display 102. Thus, output controller 410 asserts an off-state on all the pixels of display 102 only for a time period within the frame based on the significance of the suspended bit plane(s). For example, in a particular embodiment, output controller 410 is operative to couple one of first voltage supply terminal 412 or second voltage supply terminal 414 to all the pixels of display 102 via display control bus 122 in order to assert an off-state on each pixel of display 102. However, any method of asserting an off-state simultaneously on all of the pixels in display 102, responsive to a disable signal, can be employed.

Alternatively, in a second method, responsive to an indicator in flag buffer 408A or 408B indicating that each bit in a particular sequential bit plane has an off-state value, output controller 410 is operative to transfer the sequential bit plane associated with the indicator from one of frame buffers 406A and 406B to the pixels of display 102 via display data bus 124. Then output controller 410 is further operative to suspend all further sequential bit planes from being transferred from frame buffer 406A or 406B to display 102. Again, because the value of sequential bits indicate the value of other sequential bits, output controller 410 can suspend transfer of display data associated with all subsequent sequential bit planes. The benefit of this second method is that the pixels of display 102 can be driven into an off-state by writing the first sequential bit plane where all bits have a value indicative of an off-state and then preventing transfer of all subsequent sequential bit planes have an off-state value. Again, output controller 410 can suspend the transfer of many sequential bit planes within a frame based upon a single disable signal (e.g., the first sequential bit plane indicator set to a value of one).

Note that based on the above description, output controller 410 can prevent the transfer of any bit plane of a frame of display data to the pixels of display 102. Suspending the transfer of bits planes is not limited to only bit planes containing sequential bits 212. Indeed, output controller 410 can suspend the transfer of one or more bit planes containing any of binary bits 208(0-5), as well as, any of sequential bit planes containing sequential bits 212(1-4).

Light source controller 416, like output controller 410, is responsive to the disable signals generated by detection logic 404, and is operative to turn off light source 104 when a disable signal indicates that each bit in a bit plane has a value indicative of an off-state. In particular, light source controller 416 reads the indicators in flag buffers 408A and 408B associated with bit planes of data during each frame. When light source controller 416 reads an indicator flag indicating that each bit in a particular bit plane has an off-state value (e.g., indicator flag=1), then light source controller 416 turns off light source 104 via light source control bus 126 for a time period dependent on the significance of the bits in at least the bit plane associated with the indicator set to a value of one. For example, light source controller 416 could turn off light source 104 for an amount of time within the frame equal to the significance of the bit plane associated with the set indicator in flag buffer 408A or 408B. Alternatively, because sequential bits indicate the value of other sequential bits, if the indicator in flag buffer 408A or 408B is set for a sequential bit plane, then light source controller 416 could turn off light source 104 for an amount of time within a frame equal to the significance of the sequential bit plane associated with the set indicator plus the significance of all subsequent sequential bit planes. Accordingly, where sequential bits are employed, light source controller 416 can turn off light source 104 for multiple bit planes based on a single indicator flag.

Note that because light source controller 416 can turn light source 104 on and off multiple times per frame, which is over within a fraction of a second, it is beneficial to the present invention to have a light source 104 that can be turned on and off quickly within a frame. Therefore, in the present embodiment, light source 104 is an LED- or laser-based light source. However, in alternate embodiments, any other light source suitable for use in a projection system can be used, because turning the light source off is not an essential element of the invention.

Again, the present invention provides many advantages. In particular, because display control unit 110 suspends data transfer to display 102 and turns off light source 104 during portions of a frame time (e.g., during particular bit planes), display driver 106 conserves power that would otherwise be drawn by light source 104 and that would be used to transfer data and assert that data on display 102 by output controller 410. Furthermore, because display control unit 110 and light source 104 are using less power, less heat will be generated by display system 100, which will result in an overall cooler display system 100 and will extend the longevity of display system 100. Third, the present invention reduces the peak bandwidth requirements between display control unit 110 and display 102.

Yet another advantage of the present invention is that it uses a PWM scheme to drive the pixels of display 102. Therefore, display 102 can be debiased using methods well-known in the art. For example, a frame time can be divided into two sub-frames, and one frame of data can be asserted twice in different bias directions, once in a first bias direction during one sub-frame and a second time in an opposite bias direction during the other sub-frame.

Figure 5A:
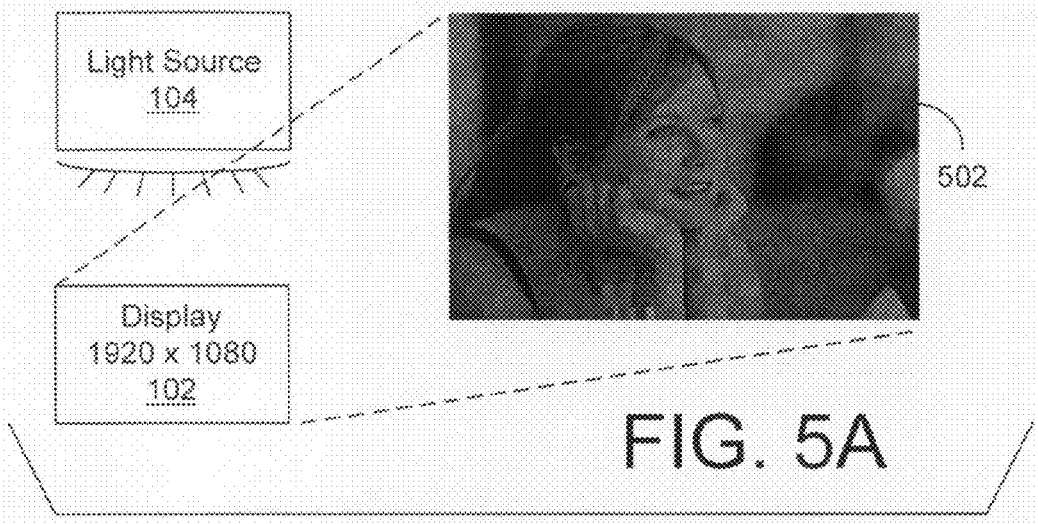
FIG. 5A shows the display of FIG. 1 being driven by a display driver of the present invention to produce a frame of an image.
Figure 5B:
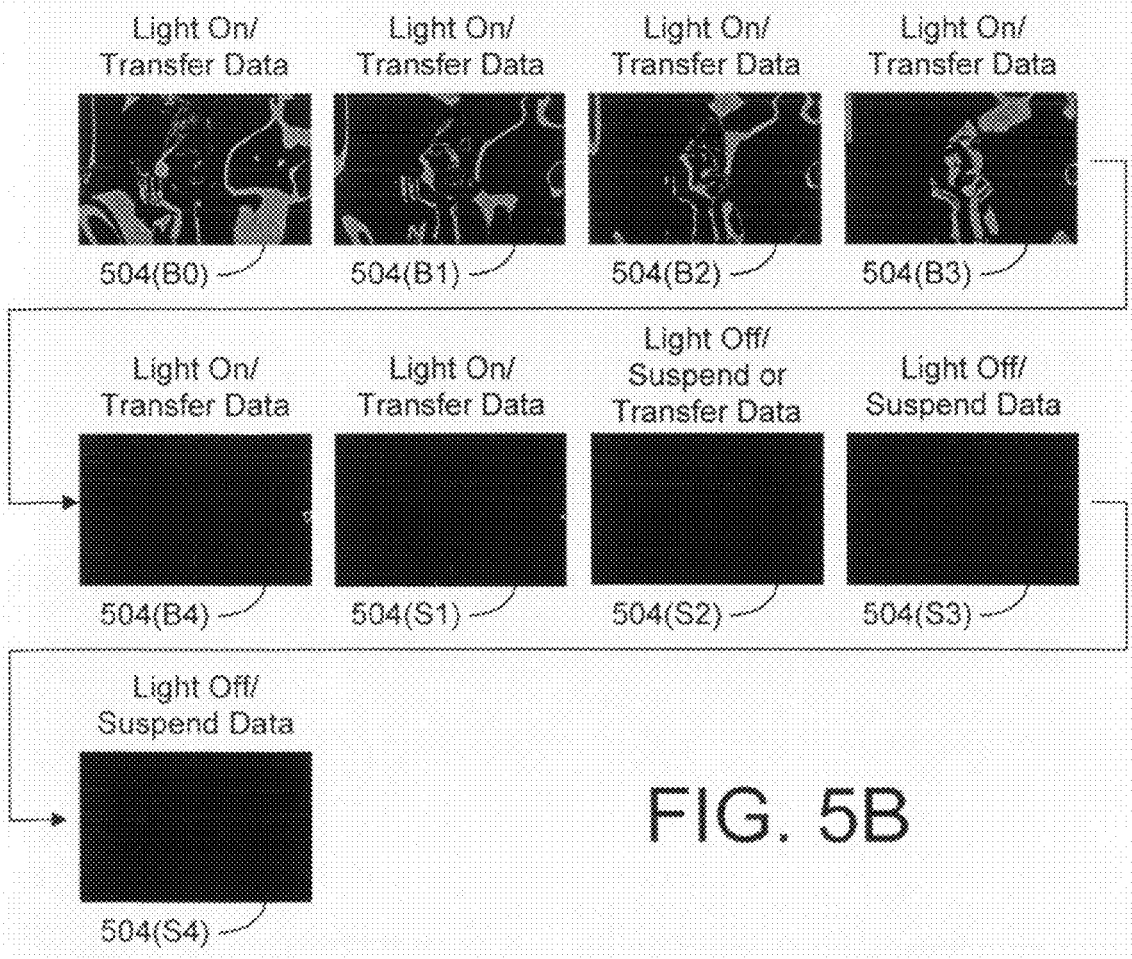
FIG. 5B shows the various bit planes that produce the image frame shown in FIG. 5A, as well as, whether or not data is transferred to the display and the display's light source is illuminated during each bit plane.

The operation of display system 100 will now be explained with reference to FIGS. 5A and 5B. FIG. 5A shows display 102 being driven by display driver 106 (FIG. 1) to produce a frame 502 of an image on display 102. FIG. 5B shows the various bit planes 504(B0-S4), associated with data word 204A, that are written to the pixels of display 102 within a frame time to produce the image frame 502 shown in FIG. 5A.

Note that bit planes 504(B0-B4) contain binary bits 208(0-4), respectively, and bit planes 504(S1-S4) contain sequential bits 212(1-4), respectively. FIG. 5B also indicates whether display data is transferred to the pixels of display 102 and whether light source 104 is illuminated. It should also be noted that the sub-images associated with bit planes 504(B0-S4) are integrated by the viewer's eye over the frame time to produce image frame 502.

According to the present invention, display driver 102 receives a binary weighted data word 202 on data input terminal set 112 for each pixel in display 102. Data manager 108 receives the binary-weighted data words 202, converts each binary-weighted data word 202 into a compound data word 204A having the same intensity as the converted binary-weighted data word 202, and then outputs each compound data word 204A onto compound data input bus 128 for display control unit 110.

In display control unit 110, data planarizer 402 receives each compound data word 204A as it is output by data manager 108 onto bus 128. Data planarizer 402 planarizes the compound data words 204A as they are received and outputs the planarized data by bit plane (i.e., by significance) onto data lines 418. Recall that each compound data word 204A had nine bits 208(0-4) and 212(1-4), such that display control unit 110 will process nine different bit planes 504(B0-S4) within a frame time to produce image frame 502.

Detection logic 404 receives a first signal on frame signal input 120 when display control unit 110 begins processing display data for frame 502. At the beginning of the frame, detection logic 404 determines which frame buffer 406A or 406B it will fill with the frame data and determines which flag buffer 408A or 408B it will set indicator flags in. In this example, detection logic 404 loads planarized data into frame buffer 406A and sets indicator flags in flag buffer 408A. Note that the indicator flags in flag buffer 408A have been cleared (e.g., all set to a value of 0) at the end of the prior frame.

Detection logic 404 receives a plurality of planarized display data from planarizer 402, reads each of the bits in each bit plane 504(B0-S4) as they are received, determines whether each of the bits in each bit plane 504(B0-S4) has a value indicative of an off-state, and if so, detection logic 404 sets an indicator flag (e.g., to a value of 1) in flag buffer 408A corresponding to a particular bit plane 504. Alternatively, where at least one data bit has an on-state value in a bit plane 504, detection logic 404 leaves the indicator flag set at a value of 0. Detection logic 404 then transfers the planarized data to frame buffer 406A where at least portions of the planarized data will be asserted on display 102 during the next frame.

As shown in FIG. 5B, for bit plane 504(B0), at least some of the B0 bits have an on-state value, which is indicated by the gray in the sub-image for bit plane 504(B0). Therefore, detection logic 404 would set an indicator flag associated with bit plane 504(B0) in flag buffer 408A to a value of zero, such that bit plane 504(B0) will be transferred to the pixels of display 102 during the next frame. Similarly, at least some of the bits in bit planes 504(B1), 504(B2), 504(B3), 504(B4), and 504(S1) have an on-state value. Therefore, detection logic 404 will leave the indicator flags associated with bit planes 504(B1), 504(B2), 504(B3), 504(B4), and 504(S1) set to a value of zero as well.

In contrast, the image produced by bit planes 504(S2), 504(S3), and 504(S4) are totally black (i.e., off) images. As such, each bit in each of bits planes 504(S2), 504(S3), and 504(S4) have an off-state value. Accordingly, detection logic 404 generates a disable signal for each of bit planes 504(S2), 504(S3), and 504(S4) by setting an indicator flag in flag buffer 408A to a value of one for each bit plane 504(S2), 504(S3), and 504(S4).

Note that bit plane 504(S2) is the first bit plane containing sequential bits where each bit in the sequential bit plane has a value indicative of an off-state. Accordingly, because sequential bits indicate the value of at least one other sequential bit, all the bits in subsequent sequential bit planes (i.e., bit planes 504(S3) and 504(S4)) following bit plane 504(S2) also have an off-state value. Additionally, at least one sequential bit in all sequential bit planes (i.e., 504(S1) preceding bit plane 504(S2) has a value indicative of an on-state.

At the end of the current frame, detection logic 404 receives a second signal indicating the end of a frame on frame signal input 120. Accordingly, detection logic 404 clears the indicators in flag buffer 408B (i.e., sets all indicators to zero), and prepares to load a new frame of data into frame buffer 406B.

Subsequently, at the start of the next frame (e.g., indicated by a Vsync signal, a signal on frame signal input, etc.), output controller 410 begins transferring display data to the pixels of display 102 to produce image frame 502. In particular, output controller 410 reads an indicator flag in flag buffer 408A corresponding to bit plane 504(B0) via indicator read bus 424. Because the indicator flag associated with bit plane 504(B0) is zero, output controller 410 asserts a signal on frame buffer 406A to output all the bits associated with bit plane 504(B0) onto display data bus 124. At the same time, output controller 410 asserts control signals (e.g., write signals, row addresses, etc.) onto display control bus 122 that cause display 102 to load bit plane 504(B0) into its pixels and display the sub-image associated with bit plane 504(B0). Output controller 410 allows bit plane 504(B0) to be asserted on the pixels of display 102 for a time period equal to the significance of each B0 bit. Output controller performs a similar process for the remaining bit planes 504(B1), 504(B2), 504(B3), 504(B4), and 504(S1). Thus, each sub image shown in FIG. 5B associated with one of bit planes 504(B0-S1) is displayed by the pixels of display 102 for a time period equal to the significance of the bits in the associated bit plane 504(B0-S1).

However, when output controller 410 reads an indicator flag from flag buffer 408A associated with bit plane 504(S2), output controller 410 suspends data transfer from frame buffer 406A to display 102. In particular, the indicator flag associated with bit plane 504(S2) is set to a value of one, which indicates to output controller 410 that all the bits in bit plane 504(S2) have a value indicative of an off-state. When sequential bits are employed in the present invention, output controller 410 can proceed according to either of the following processes.

According to a first process, output controller 410 asserts a control signal on frame buffer control bus 426 that prevents frame buffer 406A from transferring bit plane 504(S2) to display 102. Similarly, output controller 410 stops all remaining bit planes 504(S3) and 504(S4) from being transferred to display 102 because, like bit plane 504(S2), all of the bits in each of bits planes 504(S3) and 504(S4) have an off-state value. Note that output controller 410 can determine the status of the bits in bit planes 504(S3) and 504(S4) by reading indicators associated with those bit planes from flag buffer 408A. Alternatively, where the invention employs sequential bits (as it does here), once output controller 410 encounters a sequential bit plane, such as bit plane 504(S2) where an indicator flag is set to a value of one, then output controller 410 could also automatically prevent the transfer of all subsequent sequential bit planes, such as bit planes 504(S3) and

504(S4), to display 102 without reading indicator flags associated with those bit planes. Output controller 410 is able to do this because the sequential bits in bit plane 504(S2) indicate the value of the sequential bits in bit planes 504(S3) and 504(S4).

According to this first process, output controller 410 can optionally be further operative to force all the pixels of display 102 into an off-state responsive to the indicator flag associated with bit plane 504(S2) being set to a value of one. For example, in one particular embodiment, output controller 410 could couple one of voltage supply terminals 412 and 414 with all the pixels of display 102 to force the pixels into an off-state with respect to their common electrode (not shown). Forcing the pixels of display 102 into an off-state is beneficial when light source 104 remains on even though output controller 410 does not transfer new data to display 502. Forcing pixels of display 102 off in this situation prevents the image produced by bit plane 504(S1) from remaining on display 102 through the end of the frame. Alternatively, if light source 104 were turned off for bit plane 504(S2), the pixels of display 102 would not have to be forced to an off-state and no detrimental image effects would occur because no light is illuminating display 102.

According to a second process, output controller 410 would instruct frame buffer 406A to transfer bit plane 504 (S2) to display 102 such that all pixels in display 102 were in an off-state. Then, output controller 410 would prevent transfer of the remaining sequential bit planes 504(S3) and 504 (S4) to the pixels of display 102. According to this process, output controller causes the pixels of display to all assert an off-state by causing bit plane 504(S2) to be transferred to the pixels of display, but then prevents all further bit planes (e.g., 504(S3) and 504(S4)) from being transferred to display 102.

Light source controller 416 is also responsive to the indicator flags (i.e., the disable signals) in flag buffer 408A. In particular, light source controller 416 reads the indicator flags stored in flag buffer 408A that are associated with bit planes 504(B0-S4) and turns off light source 104 by asserting control signals on light source control bus 126 if an indicator flag indicates that each of the bits contained in one of bit planes 504(B0-S4) has an off-state value. If an indicator flag indicates that all the bits in one of bit planes 504(B0-S4) have an off-state value, then light source controller 416 turns off light source 104 for a time that the bit plane 504 would have been asserted on display (i.e., for a time equal to at least the significance of each bit in that bit plane). Conversely, if an indicator flag indicates that at least one bit in a bit plane 504(B0-S4) has a value indicative of an on-state, then light source controller 416 asserts control signals on bus 126 that cause light source 104 to turn on.

With regard to FIG. 5B, light source controller 416 would turn off light source 104 during the portion of the frame time associated with bit planes 504(S2), 504(S3), and 504(S4) because each of these bit planes contain no data bits that have an on-state value as described above. Furthermore, because bit planes 504(S2-S4) contain sequential bits, the indicator flag associated with bit plane 504(S2) indicates to light source controller 416 that it can keep light source 104 off during the portion of the frame that bit planes 504(S3) and 504(S4) would have been asserted on display 102, in addition to the lamp off-time for bit plane 504(S2). Because sequential bit planes 504(S1-S4) can indicate the value of other bit planes, it is not necessary that light source controller 416 read an indicator flag associated with bit planes 504(S3) and 504(S4) from flag buffer 408A.

Finally, at the end of the frame (i.e., after the time bit plane 504(S4) would have been asserted), detection logic 404 receives a signal on frame signal input 120 indicating the end of the frame. Accordingly, detection logic 404 would clear flag buffer 408A such that the indicator flags therein can be reset with new values during the following frame. In addition, output controller 410 and light source controller 416 would start driving display 102 and light source 104 with the next image frame having data stored in frame buffer 406B and disable indicators stored in flag buffer 408B.

Again, the present invention provides many advantages. In particular, according to the embodiment described in FIGS. 5A and 5B, display driver 102 conserves power because bit planes 504(S2-S4) do not have to be transferred to display 102 and light source 104 can be turned off during the frame time associated with bit planes 504(S2-S4). Furthermore, because display driver 102 and light source 104 are using less power, less heat will be generated by display system 100. Finally, the present invention reduces the peak bandwidth requirements between display control unit 110 and display 102 because bit planes 504(S2-S4) do not have to be transferred to the pixels of display 102.

Figure 6:
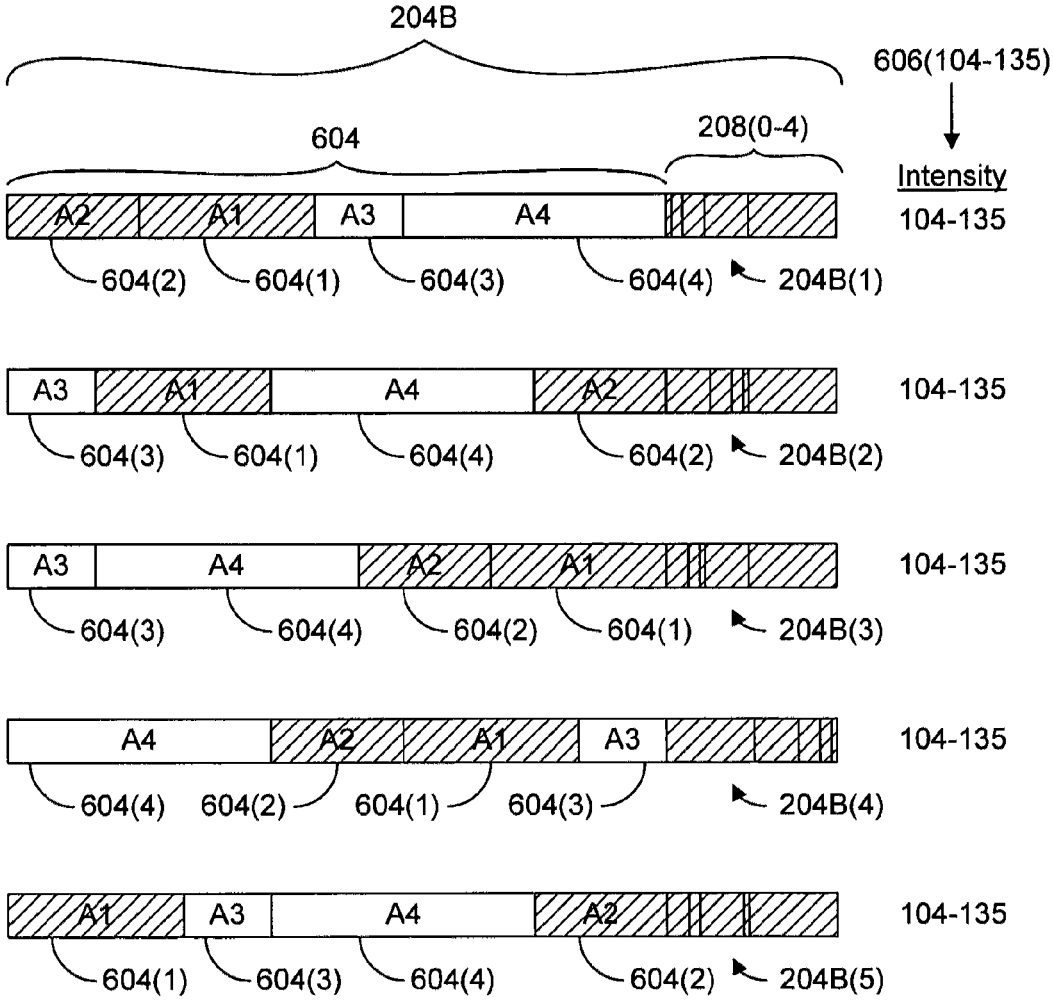
FIG. 6 is a block diagram showing various intensity values that can be defined by an alternative compound data word according to the present invention.

FIG. 6 is a diagram that shows another exemplary data word 204B containing a plurality of binary-weighted bits 208(0-4) and a plurality of arbitrarily-weighted bits 604(1-4) (labeled A1, A2, A3, and A4). Note that FIG. 6 contains five different arrangements of compound data word 204B, labeled 204B(1) through 204B(5), where at least some of the bits of compound data word 204B are sent to display control unit 110 in a random order. Like compound data word 204A, compound data word 204B includes a group of five binary-weighted data bits 208(0-4) (i.e., B0-B4). Additionally, arbitrarily-weighted bits 604(1-4) have the following weights: bit 604(1) has a weight of 59, bit 604(2) has a weight of 45, and each of bits 604(3) and 604(4) has a weight of 60.

In each of data words 204B(1-5) of the present embodiment, arbitrarily-weighted bits 604(1) and 604(2) have an on-state value (indicated by a hashed bit) and arbitrarily-weighted bits 604(3) and 604(4) have an off-state value (indicated by a blank bit). Each data word 204B(1-5) then defines an intensity value between 606(104) and 606(135), inclusive, depending on which binary bits 208(0-4) have an on-state or off-state value. Note that all binary bits 208(0-4) are hatched for simplicity because each binary bit 208(0-4) would have an on-state value to define intensity value 606(135). However, all binary bits 208(0-4) would have an off-state value to define intensity value 606(104).

As shown by data words 204B(1-5) in FIG. 6, binary bits 208 are sent to display control unit 110 before arbitrarily-weighted bits 604(1-4). However, according to data words 204B(1-5), binary bits 208(0-4) are sent to display control unit 110 out of order of significance, and arbitrarily-weighted bits 604(1-4) are also randomly ordered. FIG. 6 also shows that the order of the arbitrarily-weighted bits 604(1-4) and binary-weighted bits 208(0-4) can change between frames. For example, according to data word 204B(1), which might be received by display control unit 110 in a first frame, binary bits 208(0-4) are ordered in reverse order (i.e., B4-B0) and are followed by arbitrarily-weighted bits 604(4), 604(3), 604(1), and 604(2). However, in data word 204B(2), which might be received by display control unit 110 in a second frame, randomly-ordered binary bits 208(0-4) are followed by arbitrarily-weighted bits 604(2), 604(4), 604(1), and finally 604 (3). Therefore, even though compound data words 204B(1-5) define the same range of intensity values 606(104-135), their bits can come out of order. Additionally, the arbitrarily-weighted bits 604(1-4) are not sequential, and therefore, don't indicate the value of any other bits in the data word 204B.

It is important to note that display driver 106 can also drive display 102 using data words having randomly ordered bits (e.g., any of data words 204B(1-5), etc.). The advantage to using bits having no particular order is that the signals written to the pixels of display 102 can be controlled with greater flexibility (e.g., single pulse waveforms can be asserted on a pixel, etc.). The drawbacks to using randomly-ordered data words in the present invention is that detection logic 404 must set an indicator flag in one of flag buffers 408A or 408B for every bit plane. In addition, output controller 410 and light source controller 416 would have to read an indicator flag from one of flag buffers 408A or 408B for every bit plane of data. In addition, light source 104 would be turned on and off more cycles during a frame. Yet, despite these apparent disadvantages, display driver 102 would still conserve power, peak bandwidth requirements, and reduce heat generation over the prior art.

Again, it should be noted that the advantages of the present invention can be recognized by driving display 102 with any possible data word. For example, in data word 204B, binary bits 208 can be mixed throughout arbitrarily-weighted bits 604. Alternatively, display driver 106 could drive display 102 with all arbitrarily-weighted bits, which may or may not be sequential bits.

The methods of the present invention will now be described with respect to FIGS. 7 and 8. For the sake of clear explanation, these methods are described with reference to particular elements of the previously described embodiments that perform particular functions. However, it should be noted that other elements, whether explicitly described herein or created in view of the present disclosure, could be substituted for those cited without departing from the scope of the present invention. Therefore, it should be understood that the methods of the present invention are not limited to any particular element(s) that perform(s) any particular function(s). Further, some steps of the methods presented need not necessarily occur in the order shown. For example, in some cases two or more method steps may occur simultaneously. These and other variations of the methods disclosed herein will be readily apparent, especially in view of the description of the present invention provided previously herein, and are considered to be within the full scope of the invention.

Figure 7:
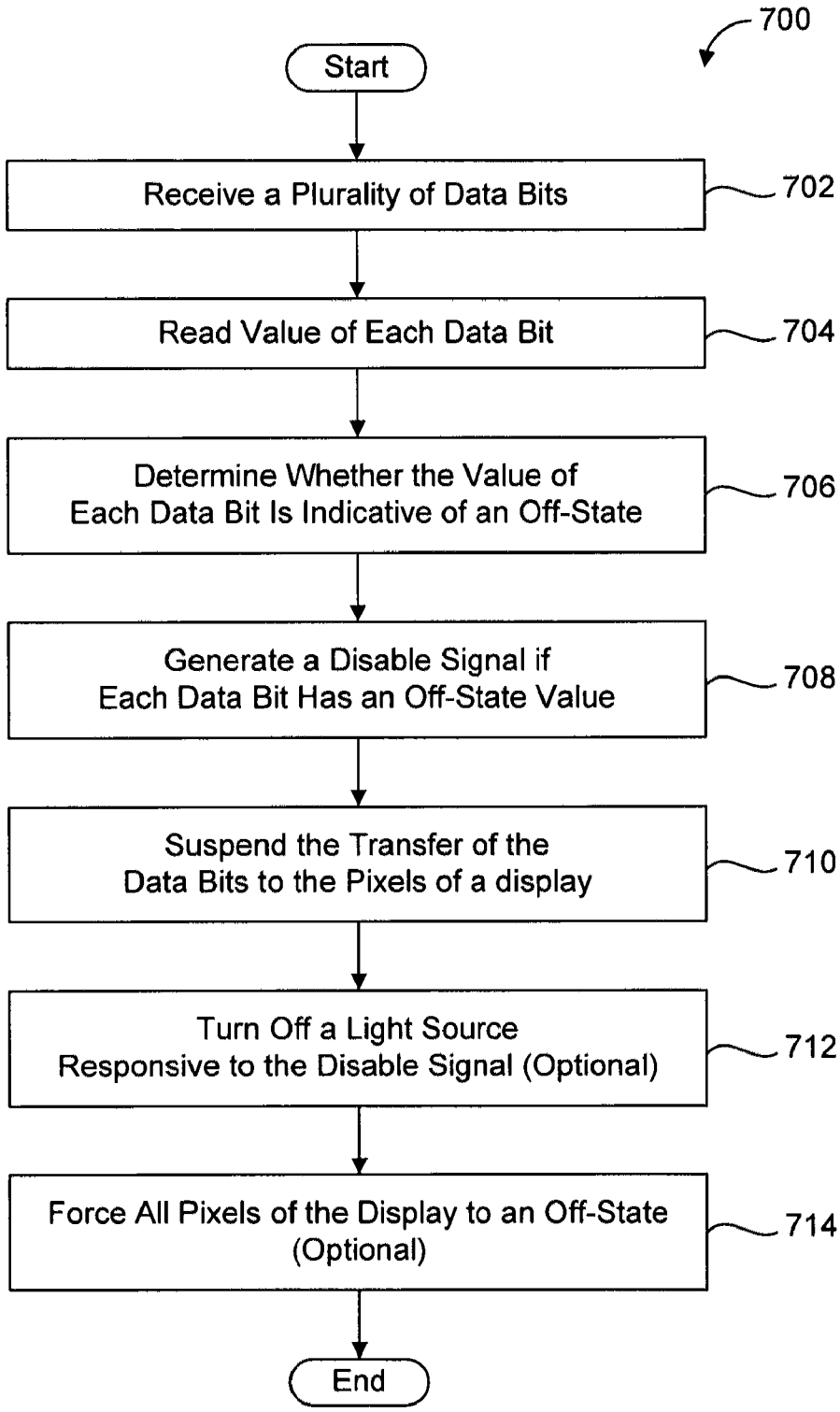
FIG. 7 is a flowchart summarizing one method of writing data to a display according to the present invention.

FIG. 7 is a flowchart summarizing one method 700 for writing data to a display 102 according to the present invention. In a first step 702, detection logic 404 receives a plurality of data bits (e.g., a complete bit plane) via data lines 418, where each of the data bits is associated with a different pixel of display 102. In a second step 704, detection logic 404 reads the value of each of the received data bits. Then, in a third step 706, detection logic 404 determines whether each of the read bits has a value indicative of an off-state. Next, in a fourth step 708, detection logic 404 generates a disable signal (e.g., sets an indicator flag in flag buffer 408A) if each of the read data bits had a value indicative of an off-state. Then, in a fifth step 710, output controller 410 receives the disable signal and suspends the transfer of data bits (e.g., from frame buffer 406A) to the pixels of display 102. Next, in an optional sixth step 712, light source controller 416 is operative to turn off light source 104 responsive to the disable signal generated by detection logic 404. In an optional step 714, output controller 410 is further operative to force the pixels of display 102 into an off-state responsive to the disable signal from detection logic 404.

Figure 8:
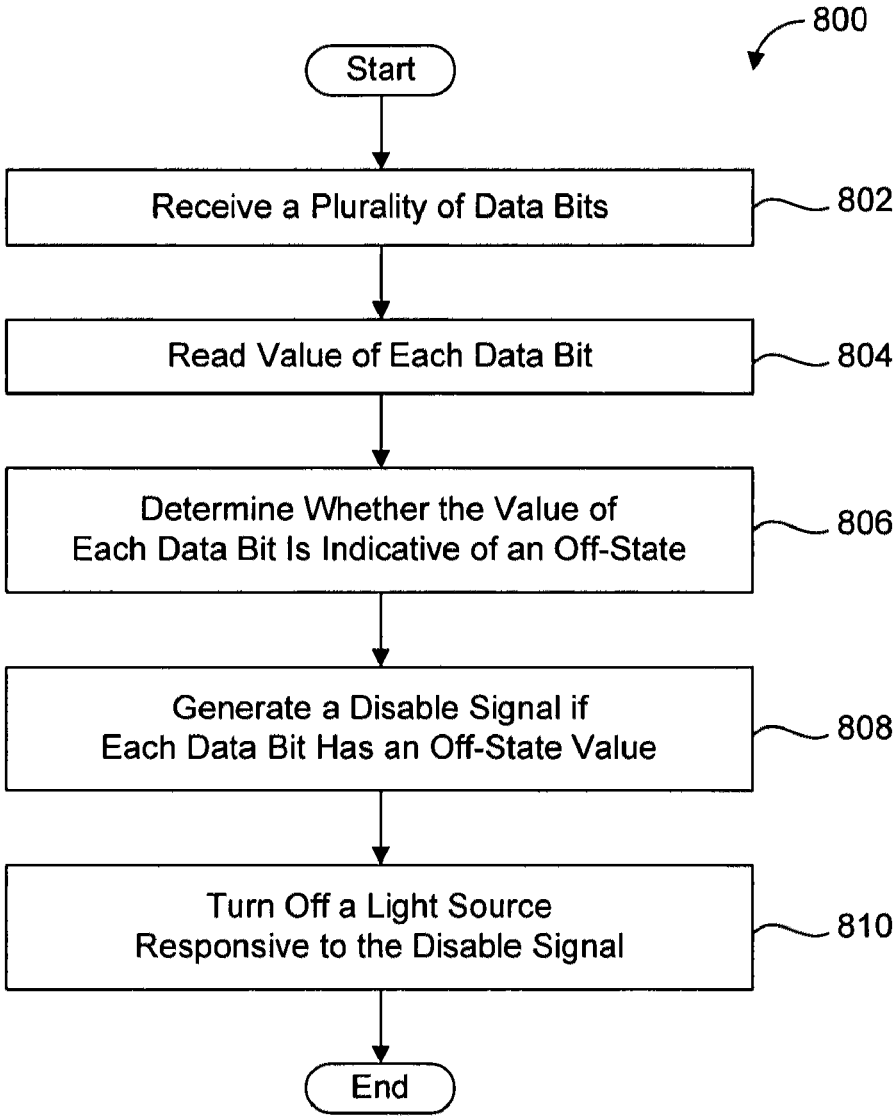
FIG. 8 is a flowchart summarizing one method of controlling a light source according to the present invention.

FIG. 8 is a flowchart summarizing one method 800 for controlling a light source 104 according to the present invention. In a first step 802, detection logic 404 receives a plurality of data bits (e.g., a complete bit plane) via data lines 418, where each of the data bits is associated with a different pixel of display 102. In a second step 804, detection logic 404 reads the value of each of the received data bits. Then, in a third step 806, detection logic 404 determines whether each of the read bits has a value indicative of an off-state. Next, in a fourth step 808, detection logic 404 generates a disable signal (e.g., sets an indicator flag in flag buffer 408A) if all the read bits had a value indicative of an off-state. Then, in a fifth step 810, light source controller 416 is operative to turn off light source 104 responsive to the disable signal generated by detection logic 404 for a time period dependent on the significance of at least one of the read data bits.

The description of particular embodiments of the present invention is now complete. Many of the described features may be substituted, altered, or omitted without departing from the scope of the invention. For example, display driver 106 could receive compound- or arbitrarily-weighted data words in the first instance, rather than converting binary-weighted data into compound data words or arbitrarily-weighted data words. As another example, the light source controller and the output controller could be combined into a single element. These and other deviations from the particular embodiments shown will be apparent to those skilled in the art, particularly in view of the foregoing disclosure.

I claim:

1. In a display system, a method for controlling a light source, said method comprising:

receiving a plurality of data bits, each of said data bits being associated with one of a plurality of multi-bit data words and a different pixel of a display, said display having an array of pixels;

reading the value of each of said data bits;

determining whether each of said data bits has a value indicative of an off-state; and generating a disable signal if each of said data bits has said value indicative of said off-state, said disable signal causing said light source to turn off; and wherein said data bits are sequential bits such that one sequential bit of one of said multi-bit data words having said value indicative of said off state indicates that at least one subsequent bit of the same multi-bit data word will also have said value indicative of said off-state.

2. A method according to claim 1, wherein said step of receiving a plurality of data bits further includes:

receiving said plurality of multi-bit data words, each of said multi-bit data words being associated with a different pixel of said display; and planarizing the bits of said plurality of multi-bit data words according to bit plane, each of said bit planes containing bits of equal significance.

3. A method according to claim 2, further comprising turning off said light source responsive to said disable signal for a time period dependent on the significance of at least one of said bit planes.

4. A method according to claim 3, wherein:

each of said data bits in a first bit plane has said value indicative of said off-state; and said light source is turned off for a time period equal to the significance of each bit in said first bit plane.

5. A method according to claim 3, wherein:

each of said data bits in a first bit plane has said value indicative of said off-state;

said light source is turned off for a time period equal to the significance of each bit in said first bit plane; and said light source is turned off for a time period equal to the significance of each bit in a second bit plane.

6. A method according to claim 2, further comprising:
determining whether each of the data bits in each of said bit planes has said value indicative of said off-state; and
generating a separate disable signal for particular ones of said bit planes where each of said data bits in said particular bit plane has said value indicative of said off-state.

7. A method according to claim 6, wherein:
said step of generating said disable signal for particular ones of said bit planes further includes setting a plurality of indicators;
each of said indicators is associated with a different one of said bit planes; and
each of said indicators indicates whether each of said data bits in said associated bit plane has said value indicative of said off state.

8. A method according to claim 1, further comprising turning said light source on in the absence of said disable signal.

9. A method according to claim 1, further comprising:
receiving a second plurality of data bits, each of said second plurality of data bits being associated with one of said plurality of multi-bit data words and a different pixel of said display;
reading the value of each of said second plurality of data bits;
determining whether each of said second plurality of data bits has said value indicative of said off-state; and
generating said disable signal if each of said second plurality of data bits has said value indicative of said off-state.

10. A method according to claim 1, further comprising:
receiving a second plurality of data bits, each of said second plurality of data bits being associated with one of said plurality of multi-bit data words and a different pixel of said display; and
keeping said light source turned off for an additional time period dependent on the significance of at least one of said second plurality of bits.

11. A method according to claim 1, wherein said light source includes a light-emitting diode (LED).

12. A method according to claim 1, wherein said light source includes a laser.

13. A method according to claim 1, wherein reading the value of each of said data bits includes evaluating each of said data bits in an electronic circuit to determine whether each of said data bits has a value of digital 0 or digital 1.

14. A method according to claim 13, wherein evaluating each of said data bits in an electronic circuit to determine whether each of said data bits is a digital 0 or a digital 1 occurs prior to transferring said data bits to said pixels of said display.

15. A method according to claim 1, wherein:
said light source illuminates all of said pixels of said display when said light source is on; and
said light source does not illuminate any of said pixels when said light source is off.

16. A display driver circuit for controlling a light source that illuminates a display having an array of pixels, said display driver circuit comprising:
an input terminal set operative to receive a plurality of data bits, each of said data bits being associated with one of a plurality of multi-bit data words and a different pixel of said display; and
detection logic operative to
read the value of each of said data bits,
determine whether each of said data bits has a value indicative of an off-state, and
generate a disable signal if each of said data bits has said value indicative of said off-state; and wherein
said disable signal causes said light source to turn off; and
said data bits are sequential bits such that one sequential bit of one of said multi-bit data words having said value indicative of said off state indicates that at least one subsequent bit of the same multi-bit data word will also have said value indicative of said off-state.

17. A display driver circuit according to claim 16, further comprising a data planarizer operative to:
receive said plurality of multi-bit data words via said input terminal set, each of said multi-bit data words being associated with a different pixel of said display; and
planarize the bits of said plurality of multi-bit data words according to bit plane, each of said bit planes containing bits of equal significance.

18. A display driver circuit according to claim 17, further comprising a light source controller, responsive to said disable signal, and operative to turn off said light source for a time period dependent on the significance of at least one of said bit planes.

19. A display driver circuit according to claim 18, wherein:
each of said data bits in a first bit plane has said value indicative of said off-state; and
said light source controller, responsive to said disable signal, is operative to turn off said light source for a time period greater than or equal to the significance of each bit in said first bit plane.

20. A display driver circuit according to claim 18, wherein:
each of said data bits in a first bit plane has said value indicative of said off-state; and
said light source controller, responsive to said disable signal, is operative to turn off said light source for a time period equal to the significance of each bit in said first bit plane, and
turn off said light source for a time period equal to the significance of each bit in a second bit plane.

21. A display driver circuit according to claim 17, wherein said detection logic is further operative to:
determine whether each of the data bits in each of said bit planes has said value indicative of said off-state; and
generate a separate disable signal for particular ones of said bit planes where each of said data bits in said particular bit plane has said value indicative of said off-state.

22. A display driver circuit according to claim 21, wherein:
said detection logic is further operative to generate separate disable signals by setting a plurality of indicators to a predetermined value, said predetermined value indicating that each of the data bits in one of said bit planes has said value indicative of said off-state;
each of said indicators is associated with a different one of said bit planes; and
each of said indicators indicates whether each of said data bits in said associated bit plane has said value indicative of said off state.

23. A display driver circuit according to claim 16, further comprising a light source controller, responsive to said disable signal, and operative to turn said light source on in the absence of said disable signal.

24. A display driver circuit according to claim 16, wherein:
said input terminal set is operative to receive a second plurality of data bits, each of said second plurality of data bits being associated with one of said plurality of multi-bit data words and a different pixel of said display; and said detection logic is operative to read the value of each of said second plurality of data bits;

determine whether each of said second plurality of data bits has said value indicative of said off-state; and generate a disable signal if each of said second plurality of data bits has said value indicative of said off-state.

25. A display driver circuit according to claim 16, wherein:

said input terminal set is operative to receive a second plurality of data bits, each of said second plurality of data bits being associated with one of said plurality multi-bit data words and a different pixel of said display; and said light source controller is operative to keep said light source turned off for an additional time period dependent on the significance of at least one of said second plurality of bits.

26. A display driver circuit according to claim 16, wherein said light source includes a light-emitting diode (LED).

27. A display driver circuit according to claim 16, wherein said light source includes a laser.

28. A display driver circuit according to claim 16, wherein said detection logic determines whether each of said data bits has said value indicative of an off-state prior to transferring said data bits to said pixels of said display.

29. A display driver circuit according to claim 16, wherein:

said light source illuminates all of said pixels of said display when said light source is on; and said light source does not illuminate any of said pixels of said display when said light source is off.

30. A display driver circuit for controlling a light source, said display driver circuit comprising:

an input terminal set operative to receive a plurality of data bits, each of said data bits being associated with one of a plurality of multi-bit data words and a different pixel of a display, said display having an array of pixels;

means for reading the value of each of said data bits;

means for determining whether each of said data bits has a value indicative of an off-state; and means for selectively turning off said light source based on the values of said plurality of data bits; and wherein said data bits are sequential bits such that one sequential bit of one of said multi-bit data words having said value indicative of said off state indicates that at least one subsequent bit of the same multi-bit data word will also have said value indicative of said off-state.

31. A non-transitory, electronically-readable storage medium having code embodied therein for causing an electronic device to:

receive a plurality of data bits, each of said data bits being associated with one of a plurality of multi-bit data words and a different pixel of a display, said display having an array of pixels;

read the value of each of said data bits;

determine whether each of said data bits has a value indicative of an off-state; and generate a disable signal if each of said data bits has said value indicative of said off-state, said disable signal for causing a light source to turn off; and wherein said data bits are sequential bits such that one sequential bit of one of said multi-bit data words having said value indicative of said off state indicates that at least one subsequent bit of the same multi-bit data word will also have said value indicative of said off-state.

32. A non-transitory, electronically-readable storage medium according to claim 31, wherein said code is further operative to cause said electronic device to:

receive said plurality of multi-bit data words, each of said multi-bit data words being associated with a different pixel of said display; and planarize the bits of said plurality of multi-bit data words according to bit plane, each of said bit planes containing bits of equal significance.

33. A non-transitory, electronically-readable storage medium according to claim 32, wherein said code is further operative to cause said electronic device to generate said disable signal for a time period dependent on the significance of at least one of said bit planes.

34. A non-transitory, electronically-readable storage medium according to claim 33, wherein:

each of said data bits in a first bit plane has said value indicative of said off-state; and said disable signal is generated for a time period equal to the significance of each bit in said first bit plane.

35. A non-transitory, electronically-readable storage medium according to claim 33, wherein:

each of said data bits in a first bit plane has said value indicative of said off-state;

said disable signal is generated for a time period equal to the significance of each bit in said first bit plane; and said disable signal is generated for a time period equal to the significance of each bit in a second bit plane.

36. A non-transitory, electronically-readable storage medium according to claim 32, wherein said code is further operative to cause said electronic device to:

determine whether each of the data bits in each of said bit planes has said value indicative of said off-state; and generate a separate disable signal for particular ones of said bit planes where each of said data bits in said particular bit plane has a value indicative of said off-state.

37. A non-transitory, electronically-readable storage medium according to claim 36, wherein:

said code is further operative to cause said electronic device to generate said disable signal for particular ones of said bit planes by setting a plurality of indicators;

each of said indicators is associated with a different one of said bit planes; and each of said indicators indicates whether each of said data bits in said associated bit plane has said value indicative of said off state.

38. A non-transitory, electronically-readable storage medium according to claim 31, wherein said light source is turned on in the absence of said disable signal.

39. A non-transitory, electronically-readable storage medium according to claim 31, wherein said code is further operative to cause said electronic device to:

receive a second plurality of data bits, each of said second plurality of data bits being associated with one of said plurality of multi-bit data words and a different pixel of said display;

read the value of each of said second plurality of data bits;

determine whether each of said second plurality of data bits has said value indicative of said off-state; and generate said disable signal if each of said second plurality of data bits has said value indicative of said off-state.

40. A non-transitory, electronically-readable storage medium according to claim 31, wherein said code is further operative to cause said electronic device to:

receive a second plurality of data bits, each of said second plurality of data bits being associated with one of said plurality of multi-bit data words and a different pixel of said display; and generate said disable signal for an additional time period dependent on the significance of at least one of said second plurality of bits.

41. A non-transitory, electronically-readable storage medium according to claim 31, wherein said disable signal is operative to cause a light-emitting diode (LED) to turn off.

42. A non-transitory, electronically-readable storage medium according to claim 31, wherein said disable signal is operative to cause a laser to turn off.

43. A non-transitory, electronically-readable storage medium according to claim 31, wherein said code is further operative to cause said electronic device to read the value of each of said data bits by evaluating each of said data bits to determine whether each of said data bits has a value of digital 0 or digital 1.

44. A non-transitory, electronically-readable storage medium according to claim 43, wherein said code is further operative to cause said electronic device to evaluate each of said data bits prior to said data bits being transferred to said pixels of said display.

45. A non-transitory, electronically-readable storage medium according to claim 31, wherein:

said light source illuminates all of said pixels of said display when said light source is on; and said light source does not illuminate any of said pixels when said light source is off.

* * * * *